US006197467B1

(12) United States Patent
Yamanaka et al.

(10) Patent No.: US 6,197,467 B1
(45) Date of Patent: Mar. 6, 2001

(54) CHARGE CONTROL AGENT, MANUFACTURING PROCESS THEREFOR AND TONER

(75) Inventors: Shun-ichiro Yamanaka, Osaka; Kazuaki Sukata, Kyoto; Masashi Yasumatsu, Osaka, all of (JP)

(73) Assignee: Orient Chemical Industries (JP)

( * ) Notice: Subject to any disclaimer, the term of this patent is extended or adjusted under 35 U.S.C. 154(b) by 0 days.

(21) Appl. No.: 09/064,661

(22) Filed: Apr. 22, 1998

(30) Foreign Application Priority Data

Apr. 22, 1997 (JP) ..... 9-120205

(51) Int. Cl.[7] ..... G03G 9/00

(52) U.S. Cl. ..... 430/110; 430/106; 430/120; 534/715; 534/575

(58) Field of Search ..... 430/110, 106, 430/120; 534/713, 575

(56) References Cited

U.S. PATENT DOCUMENTS 4,433,040 * 2/1984 Niimura et al. ..... 430/110
4,624,907 * 11/1986 Niimura et al. ..... 430/110

FOREIGN PATENT DOCUMENTS 55-84364 * 6/1980 (JP) .
9-169919 6/1997 (JP) .

OTHER PUBLICATIONS

Chemical Abstracts 94:5006, 1981.*
A.T. Peters, 1986, Metal Complex Dyes as Charge Control Agents, Dyes and Pigments No. 7 (1986) 341–350.
Mizuno, 1990, FABMS Analysis for Dyes Containing . . . , pp. 507–511, 578–585.
Mizuno et al., 1992, FDMS Analysis of Insoluble Organic . . . , pp. 569–572.

* cited by examiner

*Primary Examiner*—Christopher D. Rodee
(74) *Attorney, Agent, or Firm*—McGlew and Tuttle, P.C.

(57) ABSTRACT

Charge control agent comprising a metal complex salt compound having a monoazo compound as a ligand, wherein the metal complex salt compound is amorphous, and which is excellent in charge control properties, heat resistance and light fastness, good in dispersibility in, and wettability with, toner resins, hardly damages the photoreceptor when used in a toner, and is unlikely to drop from toner particles during charging;

process for manufacturing the charge control agent, comprising subjecting a crystalline metal complex salt compound having a monoazo compound as a ligand to wet milling in an organic solvent, or dissolving the crystalline metal complex salt compound in an organic solvent, and subsequently re-dispersing it in water; and toner for developing electrostatic images comprising said charge control agent, a toner resin, and a coloring agent, and method of use thereof.

36 Claims, 10 Drawing Sheets

CHARGE CONTROL AGENT, MANUFACTURING PROCESS THEREFOR AND TONER

BACKGROUND OF THE INVENTION

1. Field of the Invention

The present invention relates to a toner for developing electrostatic images, a charge control agent comprising an amorphous metal complex salt compound of the monoazo series for control or stabilization of the amount of charges of the toner, and a manufacturing process therefor.

2. Description of the Prior Art

In copying machines, printers and other instruments based on electrophotography, various toners containing a coloring agent, a fixing resin and other substances are used to visualize the electrostatic latent image formed on the photoreceptor having a light-sensitive layer containing an organic or inorganic photoconductive substance.

The chargeability of such toners is a key factor in electrostatic latent image-developing systems. Thus, to appropriately control or stabilize the amount of charges of a toner, a charge control agent providing a positive or negative charge is often added to the toner.

Of the conventional charge control agents in actual application, those providing a negative charge for a toner include 1:2 type metal complex salt dyes of monoazo compounds and metal complexes of aromatic hydroxycarboxylic acids such as alkylsalicylic acids.

However, many of the metal complexes having azo dye structure proposed as charge control agents are usually unstable; for example, they are likely to be decomposed or to deteriorate to lose their initial charge control capability when exposed to mechanical friction or impact, temperature or humidity changes, electric impact, light irradiation, etc. Also, even such metal complexes possessing a practically applicable charge providing property are often problematic as to charge stability or often contain impurity chemicals lacking charge control effect due to differences in production method and conditions, posing many problems regarding charge control agent quality stability, reliability and other aspects.

Among charge control agents capable of resolving these problems are the crystalline metal complex salts having the following structures:

(a)

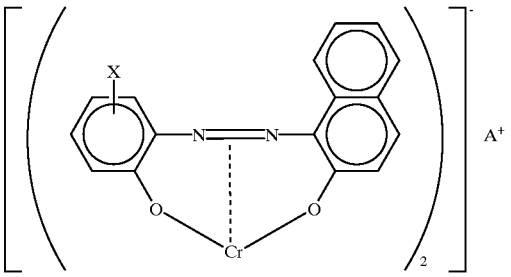

-continued (b)

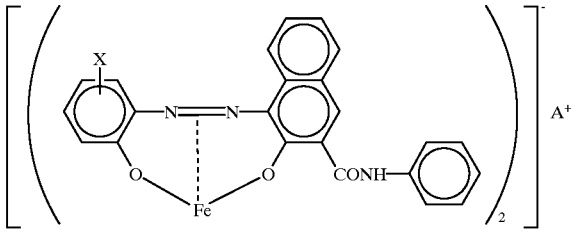

In the above formulas, X represents H (i.e. hydrogen), a halogen, $—SO_2NH_2$, a nitro group, an alkyl group or the like; and A represents H (i.e. hydrogen), an alkali metal, an amine or the like.

Such metal complex salt dyes are what are called 1:2 type azo metal complex dyes wherein 2 molecules of a monoazo dye are coordinated to 1 trivalent metal atom.

The present inventors found problems to be resolved in such 1:2 type azo metal complex dyes, including the possibility that the metal complex dye, when used as a charge control agent in a toner for a long period of time, can damage the photoreceptor by partially exposed crystals on the surface of toner particles because such dye generally possesses hard crystallinity, and the likelihood that the dye tends to drop (separate out) from toner particles during charging (i.e. frictional charging) due to the hard crystallinity.

SUMMARY OF THE INVENTION

A first object of the present invention is to provide a charge control agent excellent in charge control properties (charge-providing property and stability), heat resistance and light fastness, good in dispersibility in, and wettability (compatibility) with, toner resins, which is amorphous in nature and hardly damages the photoreceptor when used in a toner, and which is unlikely to drop (separate out) from toner particles during charging, and a manufacturing process therefor.

A second object of the present invention is to provide a toner for developing electrostatic images excellent in environmental resistance (stability of charge control characteristics to changes in temperature and humidity), storage stability (stability over time of charge control characteristics) and durability (charge control characteristic stability in frequently repeated use of toner), good in charge rise property, which contains such a charge control agent that hardly damages the photoreceptor and that is amorphous in nature and unlikely to drop during charging, and which insures stable copy images.

The charge control agent of the present invention is a charge control agent comprising a metal complex salt with a monoazo compound as a ligand, wherein the metal complex salt is amorphous. This charge control agent may be defined as a charge control agent wherein an X-ray diffraction spectrum of the above described metal complex salt demonstrates that the metal complex salt is amorphous.

Also, this charge control agent may be defined as a charge control agent wherein the degree of crystallinity of the above described metal complex salt, as determined by the multiple peak separation method, is not higher than 50% over the 2θ range from 5° to 30° (wherein θ indicates the Bragg angle).

This degree of crystallinity is preferably not higher than 30%.

Also, the charge control agent of the present invention may be defined as a charge control agent wherein the above described metal complex salt is a metal complex salt compound represented by General Formula (I) below:

(I)

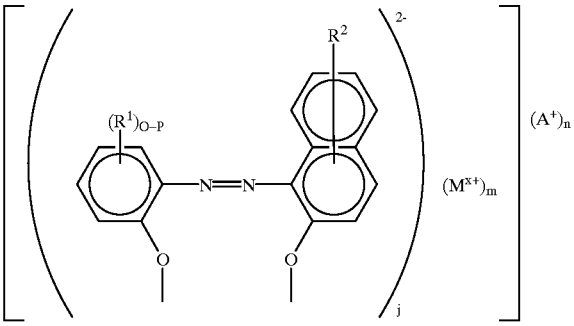

wherein $(R^1)_{0-p}$ means the presence of 0 to p units of the substituent $R^1$;

$R^1$ represents an alkyl group that has or does not have a substituent (i.e. that is substituted or unsubstituted), a cycloalkyl group, a halogen, a nitro group, an alkenyl group, an aryl group that is subjected to or not subjected to ring (i.e. nuclear) substitution (i.e. that is ring substituted or unsubstituted), an aralkyl group that is subjected to or not subjected to ring substitution (i.e. that is ring substituted or unsubstituted), or an $—SO_2N(R^{11})_2$ group [in which the 2 units of $R^{11}$, whether identical or not (i.e. the same or different), each represent H (i.e. hydrogen), a lower alkyl group, an aryl group that is subjected to or not subjected to ring substitution, or an aralkyl group that is subjected to or not subjected to ring substitution];

p represents an integer from 1 to 4;

$R^2$ represents

H (i.e. hydrogen), an alkyl group that is branched or not branched (i.e. unbranched), a halogen, a nitro group, an alkenyl group, an aryl group that is subjected to or not subjected to ring substitution (i.e. that is ring substituted or unsubstituted), an aralkyl group that is subjected to or not subjected to ring substitution (i.e. that is ring substituted or unsubstituted), $—SO_3L$ [in which L represents H (i.e. hydrogen), Na, K, $NH_4^+$ or organic ammonium], an $—SO_2N(R^{11})_2$ group [in which the 2 units of $R^{11}$, whether identical or not, each represent H (i.e. hydrogen), a lower alkyl group, an aryl group that is ring substituted or unsubstituted, or an aralkyl group that is ring substituted or unsubstituted], or a $—CON(R^{12})_2$ group [in which the 2 units of $R^{12}$, whether identical or not, represent H (i.e. hydrogen), a lower alkyl group, an aryl group that is subjected to or not subjected to ring substitution (i.e. that is ring substituted or unsubstituted), or an aralkyl group that is subjected to or not subjected to ring substitution (i.e. that is ring substituted or unsubstituted)];

j represents the number of monoazo compound molecules coordinated to the metal M, and specifically 1, 2, 3 or 6;

$(M^{x+})_m$ represents m units of a metal having an atomic valency of x, m representing 1, 2 or 4; and $(A^+)_n$ represents n units of a neutralizing counter-ion selected from the group consisting of $H^+$, $NH_4^+$, $Na^+$, $K^+$ and organic ammonium, in which n=2j−mx, such that $2j \geqq mx$ (i.e. 2j is greater than or equal to mx), provided that when j=1, and x represents 2, n may be 0 (m thus also being 1).

The central atom of the above described metal complex salt in this charge control agent is preferably an atom of divalent or trivalent metal (e.g., Fe, Co, Zn, Cu, Cr, Al, Ni), more preferably, an iron atom having an atomic valency of 2 or 3, although other central atoms such as tetravalent metal atoms (e.g. Ti, Si) may also be used.

The charge control agent of the present invention, comprising an amorphous metal complex salt compound with a monoazo compound as a ligand, as described above, can be obtained (1) by subjecting a crystalline metal complex salt compound with a monoazo compound as a ligand (e.g. a metal complex salt compound represented by General Formula (I)) to wet milling in an organic solvent, or (2) by dissolving the crystalline metal complex salt in an organic solvent, and subsequently re-dispersing it in water.

The toner of the present invention for developing electrostatic images comprises the above described charge control agent comprising an amorphous metal complex salt compound having a monoazo compound as a ligand, a resin for toners (toner resin), and a coloring agent.

Because of its physical and chemical characteristics, the charge control agent of the present invention is good in dispersibility in, and wettability (compatibility) with, resins for toners, hardly damages the photoreceptor and is unlikely to drop from toner particles when used in toners, and is excellent in negative charge-providing property, stability, environmental resistance, storage stability and durability.

Also, according to the process of the present invention for manufacturing a charge control agent, such a charge control agent of the stated characteristics can be produced.

Moreover, the toner of the present invention for developing electrostatic images is excellent in charge control performance, environmental resistance, storage stability and durability because it contains the charge control agent of the present invention, hardly damages the photoreceptor by the charge control agent contained therein, which is unlikely to drop during charging, and, in addition, even when used in toners of various resin compositions, it retains toner quality stability and reliability and forms high quality toner images.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter and examples in which preferred embodiments of the invention are illustrated.

DETAILED DESCRIPTION OF THE INVENTION

Figure 1:
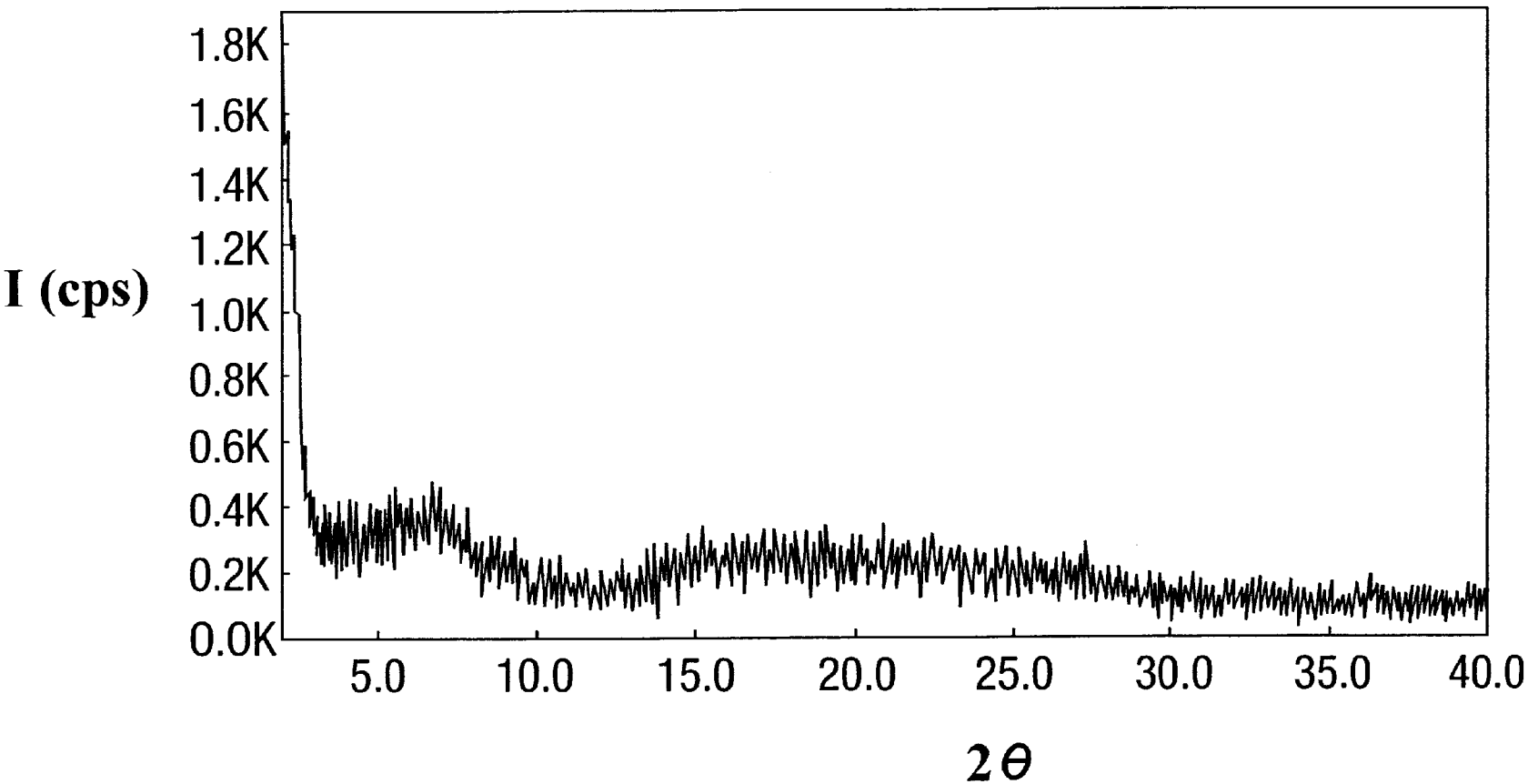
FIG. 1 is an X-ray diffraction spectrum of the amorphous iron complex salt obtained in Example 1.

The charge control agent of the present invention is preferably an amorphous metal complex salt compound represented by General Formula (I) above.

Metal complex salts represented by General Formula (I) above include the following groups (i) to (iv) of metal complex salts:

(i) 1:2 type metal complex salts of General Formula (I) wherein j=2, $(M^{x+})_m=(M^{x+})_1$, and $(A^+)_n=(A^+)_{4-x}$. These metal complex salts are hereinafter represented by Formula 1 below:

$$[(D)_2\cdot(M^{x+})]\,(A^+)_{4-x} \qquad \text{Formula 1}$$

(ii) 2:3 type metal complex salts of General Formula (I) wherein j=3, $(M^{x+})_m=(M^{x+})_2$, and $(A^+)_n=(A^+)_{4-x}$. These metal complex salts are hereinafter represented by Formula 2 below:

$$[(D)_3\cdot(M^{x+})_2]\,(A^+)_{6-2x} \qquad \text{Formula 2}$$

(iii) 4:6 type metal complex salts of General Formula (I) wherein j=6, $(M^{x+})_m=(M^{x+})_4$, and $(A^+)_n=(A^+)_{12-4x}$. These metal complex salts are hereinafter represented by Formula 3 below:

$$[(D)_6\cdot(M^{x+})_4]\,(A^+)_{12-4x} \qquad \text{Formula 3}$$

(iv) 1:1 type metal complex salts of General Formula (I) wherein j=1, $(M^{x+})_m=(M^{x+})_1]\,(A^+)_n=(A^+)_{2-x}$, and x=2. These metal complex salts are hereinafter represented by Formula 4 below:

$$[(D)_1\cdot(M^{2+})] \qquad \text{Formula 4}$$

With respect to Formulas 1 through 4 above, D is a ligand wherein a monoazo compound having 2 metallizable OH groups is coordinated to the metal M.

The compounds (metal complex salts) represented by Formula 1 are metal complex salts wherein 2 monoazo compound molecules are coordinated to 1 atom of the metal M;

the compounds represented by Formula 2 are metal complex salts wherein 3 monoazo compound molecules are coordinated to 2 atoms of the metal M;

the compounds represented by Formula 3 are metal complex salts wherein 6 monoazo compound molecules are coordinated to 4 atoms of the metal M; and the compounds represented by Formula 4 are metal complex salts wherein 1 monoazo compound molecule is coordinated to 1 atom of the divalent metal M.

The number n of respective counter-ions ($A^+$) is (2j−mx) as necessary to neutralize the negative charge of the mother compound (the complex of the monoazo dye compound ligand D and metal M) wherein 2 j≧mx, n being 0 when j and m are each 1 and x is 2.

The charge control agent of the present invention may comprise any 1 kind of amorphous metal complex salt selected from the above groups of compounds; for example, it may be a mixture of 2 kinds of amorphous metal complex salts selected from the 2 groups of compounds represented by Formulas 1 and 2, respectively;

a mixture of 2 kinds of amorphous metal complex salts selected from the 2 groups of compounds represented by Formulas 1 and 2, respectively, and a small amount of 1 kind of amorphous metal complex salt selected from the group of compounds represented by Formula 3 or 4; or a mixture of 4 kinds of amorphous metal complex salts selected from the 4 groups of compounds represented by Formulas 1, 2, 3 and 4, respectively.

The monoazo metal compounds represented by Formulas 2 and 3, respectively, are new crystalline compounds identified by mass analyses (FAB-MS spectral analysis, FD-MS spectral analysis, etc.), and are disclosed in Japanese Patent Application No. 297414/1995.

The charge control agent of the present invention may be deemed a charge control agent wherein an X-ray diffraction spectrum of the above described metal complex salt demonstrates that the metal complex salt is amorphous. The fact that an X-ray diffraction spectrum demonstrates that the metal complex salt is amorphous means that the X-ray diffraction pattern shows no diffraction peaks, as is the case shown in FIGS. 1 and 4, or shows no marked diffraction peaks, as is the case shown in FIG. 5.

This state can be defined as the fact that the ratio of the sum of the spectral strength of the crystalline portion to the sum of the spectral strength of the entire portion, as calculated by the multiple peak separation method, for the X-ray diffraction spectrum of the metal complex salt, is not higher than 50% (i.e. not predominantly crystalline, and thus predominantly amorphous) over the 2θ range from 5° to 30° (wherein θ indicates the Bragg angle). The charge control agent of the present invention is preferably an amorphous metal complex salt wherein this degree of crystallinity is not higher than 30%, and thus the amorphous portion is predominant (more than 50%, e.g. 70% or more).

With respect to General Formula (I), the substituent $R^1$ is exemplified by:

halogens such as Cl, Br, I and F;

a nitro group;

alkyl groups preferably having I to 20 carbon atoms, more preferably 1 to 12 carbon atoms, that are branched or not branched (i.e. unbranched), such as methyl, ethyl, n-propyl, isopropyl, n-butyl, isobutyl, sec-butyl, tert-butyl, n-octyl, tert-octyl, 2-ethylhexyl, n-decyl and dodecyl;

halo-substituted alkyl groups such as trifluoromethyl;

alkoxy-substituted alkyl groups such as methoxypropyl and 2-ethylhexyloxypropyl;

cycloalkyl groups such as cyclohexyl, cycloheptyl and cyclooctyl;

alkenyl groups such as allyl groups, isopropenyl and butenyl;

aralkyl groups that are subjected to or not subjected to ring substitution (i.e. ring substituted or unsubstituted) such as by lower alkyl groups having 1 to 3 carbon, such as benzyl, benzyls substituted by lower alkyls, phenylethyl, phenylpropyl, naphthylmethyl and naphthylethyl;

aryl groups that are subjected to or not subjected to ring substitution (i.e. ring substituted or unsubstituted) such as by lower alkyls having 1 to 3 carbon atoms or halogens, such as phenyls, naphthyls, phenyls substituted by lower alkyls, naphthyls substituted by lower alkyls, halogenated phenyls and halogenated naphthyls;

—$SO_2N(R^{11})_2$ groups [in which the 2 units of $R^{11}$, whether identical or not (i.e the same or different), independently represent H (i.e. hydrogen), a lower alkyl group having 1 to 3 carbon atoms, an aryl group that is subjected to or not subjected to ring substitution (i.e. ring substituted or unsubstituted) such as by lower alkyls having 1 to 3 carbon atoms or halogens, or an aralkyl group that is subjected to or not subjected to ring substitution (i.e. ring substituted or unsubstituted) such as by lower alkyls having 1 to 3 carbon atoms], such as the groups —$SO_2NH_2$, —$SO_2N(alkyl)_2$, —$SO_2NH$(phenyl) and —$SO_2NH$(benzyl.

Preferred examples of $(R^1)_{0-p}$ include those wherein 1 or 2 of the p units of the substituent $R^1$ are chlorine, alkyl groups, nitro groups or —$SO_2NH_2$;

those wherein p=2 and 2 different units of $R^1$ are an alkyl group and a nitro group, respectively;

those wherein p=2 and 2 different units of $R^1$ are an alkyl group and another substituent, respectively; and those wherein p=0, i.e., wherein there are no units of the substituent $R^1$.

With respect to General Formula (I), the substituent $R^2$ is exemplified by:

H (i.e. hydrogen);

halogens such as Cl, Br, I and F;

a nitro group;

alkyl groups preferably having 1 to 20 carbon atoms, more preferably 1 to 12 carbon atoms, that are branched or not branched (i.e. unbranched), such as methyl, ethyl, n-propyl, isopropyl, n-butyl, isobutyl, sec-butyl, tert-butyl, n-octyl, tert-octyl, 2-ethylhexyl, n-decyl and dodecyl;

alkenyl groups such as allyl groups, isopropenyl and butenyl;

aralkyl groups that are subjected to or not subjected to ring substitution (i.e. ring substituted or unsubstituted) such as by lower alkyls having 1 to 3 carbon atoms, such as benzyl, benzyls substituted by lower alkyls, phenylethyl, phenylpropyl, naphthylmethyl and naphthylethyl;

aryl groups that are subjected to or not subjected to ring substitution (i.e. ring substituted or unsubstituted) such as by lower alkyls having 1 to 3 carbon atoms or halogens, such as phenyls, naphthyls, phenyls substituted by lower alkyls, naphthyls substituted by lower alkyls, halogenated phenyls and halogenated naphthyls;

—$SO_2N(R^{11})_2$ groups [in which the 2 units of $R^{11}$, whether identical or not (i.e. the same or different), represent H (i.e. hydrogen), a lower alkyl group having 1 to 3 carbon atoms, an aryl group that is subjected to or not subjected to ring substitution (i.e. ring substituted or unsubstituted) such as by lower alkyls having 1 to 3 carbon atoms or halogens, or an aralkyl group that is subjected to or not subjected to ring substitution (i.e. ring substituted or unsubstituted) such as by lower alkyls having 1 to 3 carbon atoms], such as the groups —$SO_2NH_2$, —$SO_2N(alkyl)_{21}$ —$SO_2NH$— (phenyl) and —$SO_2NH$(benzyl);

—$CON(R^{12})_2$ groups [in which the 2 units of $R^{12}$, whether identical or not (i.e. the same or different), represent H (i.e. hydrogen), a lower alkyl group having 1 to 3 carbon atoms, an aryl group that is subjected to or not subjected to ring substitution (i.e. ring substituted or unsubstituted) such as by lower alkyls having 1 to 3 carbon atoms or halogens, or an aralkyl group that is subjected to or not subjected to ring substitution (i.e. ring substituted or unsubstituted) such as by lower alkyls having 1 to 3 carbon atoms], such as the groups —$CONH_2$, —CONH(alkyl), —CON— $(alkyl)_2$, —CONH(phenyl) and —CONH(benzyl).

Preferred examples of $R^2$ include those based on 2-naphthol (β-naphthol) ($R^2$=H), those based on alkyl-2-naphthol ($R^2$=alkyl), and those based on naphthol ASs (i.e. β-hydroxy naphthoic acid anilides), such as amide groups wherein $R^2$ is -CONH[phenyl-$(R^{13})_{0-2}$], i.e. as represented by the following formula:

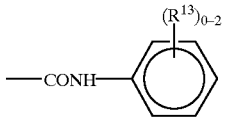

wherein $(R^3)_{0-2}$ means the presence of 0 to 2 units of the substituent $R^{13}$, $R^{13}$ representing a halogen (e.g., Cl, Br, I or F), a lower alkyl group having 1 to 3 carbon atoms (e.g. methyl, ethyl, etc.), a lower alkoxy group having 1 to 3 carbon atoms (e.g. methoxy, ethoxy, etc.), a nitro group, or the like.

In the present invention, depending on the reaction conditions, the desired amorphous metal complex salt compound with a monoazo compound as a ligand or a precursor crystalline metal complex salt compound having the same chemical structure can be produced by reacting a metallizable monoazo compound corresponding to the above ligand D and a metallizing agent in a water system, an organic solvent system or a water-organic solvent system; these metal complex salts can be separated in the form of, for example, protonic acids, sodium salts, ammonium salts, or amine salts, as with commonly known 1:2 type azo metal complex salt dyes.

Specifically, the above described desired amorphous or precursor crystalline metal complex salt can be obtained by reacting (2-hydroxy-[$(R^1)_{0-p}$]phenyl) (2-hydroxy-[$R^2$] naphthyl) diazine, i.e. a monoazo compound represented by the formula:

(c)

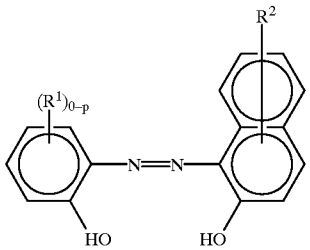

wherein $(R^1)_{0-p}$ and $R^2$ have the same definitions as those shown above, with a divalent or trivalent metallizing agent (e.g., ferrous sulfate, or ferric sulfate) by the conventional method in water and/or an organic solvent, preferably a water-soluble organic solvent (e.g., N,N-dimethylformamide or DMF). Generally, the reaction product dissolved in the organic solvent is precipitated by dispersion in an appropriate amount of water, which is then separated by filtration and washed with water and dried.

Organic solvents useful for such metallizing reactions include water-soluble organic solvents, including alcohol-series, ether-series and glycol-series organic solvents such as methanol, ethanol, and the like, ethylene glycol monomethyl ether, ethylene glycol monoethyl ether, propylene glycol monomethyl ether, ethylene glycol dimethyl ether (monoglyme), diethylene glycol dimethyl ether (diglyme), ethylene glycol diethyl ether, triethylene glycol dimethyl ether (triglyme), tetraethylene glycol dimethyl ether (tetraglyme), and the like, ethylene glycol and propylene glycol; and aprotic polar solvents such as N,N-dimethylformamide (DMF), N,N-dimethylacetamide, N-methyl-2-pyrrolidone and dimethyl sulfoxide.

Preference is given to aprotic polar solvents such as N,N-dimethylformamide, N,N dimethylacetamide, N-methyl-2-pyrrolidone and dimethyl sulfoxide.

The amount of organic solvent used, i.e. by way of illustration only and not subject to limitation, may be 2 to 5 parts by weight per part by weight of the monoazo compound (corresponding to D) used as the ligand in the metal complex salt.

Examples of metal atoms M capable of chelate binding with the 2 OH groups in the above described monoazo compound include trivalent metals such as iron (III), chromium and aluminum as well as copper (III); divalent metals such as iron (II), cobalt and nickel as well as copper (II) and zinc; and tetravalent metals such as titanium and silicon. In the present invention, divalent or trivalent iron is preferred.

Metallizing agents preferably used to synthesize the above described amorphous or crystalline metal complex salt compound include iron compounds such as ferric chloride, ferric sulfate, ferrous sulfate and ferric nitrate; chromium compounds such as chromium formate, chromium sulfate, chromium chloride and chromium nitrate; aluminum compounds such as aluminum sulfate and basic aluminum acetate; metal chlorides such as nickel chloride, cobalt chloride and titanium tetrachloride; and tetraalkoxy titanium and tetraalkoxy silane.

The amount of metallizing agent used is normally ⅓ to 2 atomic equivalents, preferably ½ to ⅔ atomic equivalents, per equivalent of the monoazo compound serving as the ligand.

When synthesized as described above, the reaction product is usually obtained as various mixtures, depending on the reaction conditions, etc., including a mixture containing a 1:2 type metal complex salt (Formula 1 above), a small amount of a 2:3 type metal complex salt (Formula 2 above) and a trace of a 1:1 type metal complex salt (Formula 4 above);

a mixture containing a 2:3 type metal complex salt (Formula 2 above) and a small amount of a 4:6 type metal complex salt (Formula 3 above); and a mixture containing a 1:2 type metal complex salt (Formula 1 above), a 2:3 type metal complex salt (Formula 2 above) and a trace of a 4:6 type metal complex salt (Formula 3 above) or 1:1 type metal complex salt (Formula 4 above).

The composition of the reaction product obtained as such a mixture also depends on the desired product and reaction conditions for the desired product; in the case of iron complex salts, the reaction product is generally obtained mainly as a 1:2 type metal complex salt or as a mixture of the 1:2 and 2:3 types. Separation of a single compound from these mixtures is impractical; moreover, the charge control agent of the present invention need not be a single substance. However, individual products can be identified by FD-MS analysis.

Although the present inventors performed various chromatographies in an attempt to isolate the reaction product, isolation was difficult. With this in mind, the FD-MS technique, known to preferentially demonstrate molecular ion peaks, was used to identify the above described metal complex salt.

Because the FD (field desorption) technique and the FAB (fast atom bombardment) technique are soft ionization methods, fragmentation is unlikely and a simple spectrum is obtained, resulting in the preferential demonstration of molecular ion peaks [Mizuno, Kagaku to Kogyo, 64, 578, 507 (1990); Mizuno et al., Kagaku to Kogyo, 66, 569 (1992)].

On the other hand, it was confirmed by X-ray diffraction spectrometry using CuK $\alpha$ rays whether the product (mixture) obtained was amorphous or crystalline. When the degree of crystallinity of the above described metal complex salt, as determined by the multiple peak separation method, is not higher than 50% over the 2 $\theta$ range from 50 to 300 (wherein $\theta$ indicates the Bragg angle), the metal complex salt can be regarded as an amorphous metal complex salt in the present invention, i.e. a predominantly amorphous (especially in excess of 50% amorphous) metal complex salt, as desired. Preferably, the degree of crystallinity is not higher than 30%.

Although most metal complex salts (dyes) produced by known methods are normally crystalline, the metal complex salt synthesized by the method of Example 1 below, for example, was confirmed as amorphous, judging from its X-ray diffraction spectrum. In contrast, the metal complex salt synthesized by the method of Example 2 below yielded an X-ray diffraction spectrum demonstrating crystallinity.

When the metal complex salt compound obtained by synthesis is crystalline, it can be used as the charge control agent of the present invention after conversion into an amorphous metal complex salt compound by wet milling in an organic solvent (e.g., alcohol solvent such as isopropanol), as in Example 2 below, or by dissolving it in an organic solvent such as DMF (N,N-dimethylformamide), as in Example 3 below, and subsequently re-dispersing it in water.

Organic solvents for converting a crystalline metal complex salt to an amorphous metal complex salt by wet milling or re-dispersion following dissolution include the same reaction solvents as those for the above described metallizing reaction, e.g., monohydric alcohols such as methanol, ethanol, propanol and isopropanol;

glycol monoethers such as ethylene glycol monomethyl ether, ethylene glycol monoethyl ether and propylene glycol monomethyl ether;

ethylene glycol diethers such as ethylene glycol dimethylether (monoglyme), diethylene glycol dimethyl ether (diglyme), ethylene glycol diethyl ether, triethylene glycol dimethyl ether (triglyme) and tetraethylene glycol dimethyl ether (tetraglyme);

glycols such as ethylene glycol and propylene glycol; and aprotic polar solvents such as N,N-dimethylformamide, N,N-dimethylacetamide, N-methyl-2-pyrrolidone and dimethyl sulfoxide.

Also usable are ketone solvents such as methyl ethyl ketone (MEK) and methyl isobutyl ketone (MIBK), and benzene solvents such as toluene and xylene.

In wet milling (wet dispersion) using such solvents, various dispersing machines for pigment dispersion etc., such as ball mills, colloidal mills, paint shakers, sand mills (e.g., bead mills), super mills, agitator mills, DYNO-MILL (trade name) and the like, can be used. Grinding media which can be used for wet milling include, for example, glass beads, zirconia beads, porcelain beads, and tungsten carbide or stainless steel beads.

Examples of monoazo compounds having 2 metallizable OH groups corresponding to the above described ligand D include, but are not limited to, $D^1$ through $D^{27}$ below. The substitutional position of the substituent $R^1$ for the diazo component in these monoazo compounds is based on the phenol (derivative).

TABLE 1

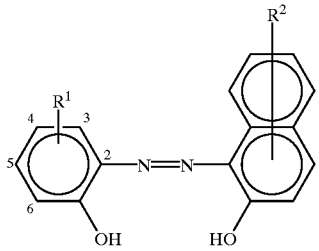

| D | $R^1$ (p = 1) | $R^2$ |
|---|---|---|
| $D^1$ | 4-Cl | H |
| $D^2$ | 4-$SO_2NH_2$ | H |
| $D^3$ | 4-$SO_2CH_3$ | H |
| $D^4$ | 4-$C_5H_{11}$ (tert-) | H |
| $D^5$ | 4-$C_4H_9$ (tert-) | H |
| $D^6$ | 4-$CH_3$ | H |
| $D^7$ | 4-cyclohexyl | H |
| $D^8$ | 4-phenyl | H |
| $D^9$ | 4-$NO_2$ | H |
| $D^{10}$ | 5-$NO_2$ | H |

TABLE 2

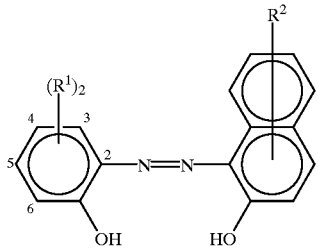

| D | $R^1$ (p = 2) | | $R^2$ |
|---|---|---|---|
| $D^{11}$ | 4-$C_5H_{11}$ (tert-) | 6-$NO_2$ | H |
| $D^{12}$ | 4-Cl | 6-$NO_2$ | H |
| $D^{13}$ | 4-$NO_2$ | 6-$NO_2$ | H |
| $D^{14}$ | 4-Cl | 6-Cl | H |

TABLE 3

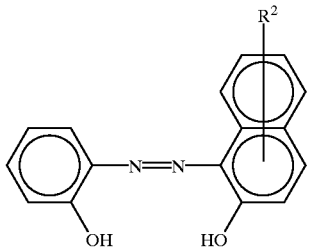

D $R^2$ $D^{15}$

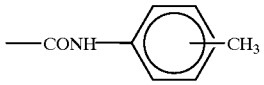

$D^{16}$

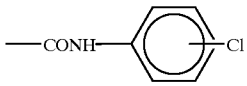

$D^{17}$ —CONH—$C_3H_7$
$D^{18}$ —$C_8H_{17}$ (tert-)
$D^{19}$ —$SO_3H$
$D^{20}$ —$SO_2NH_2$ $D^{21}$

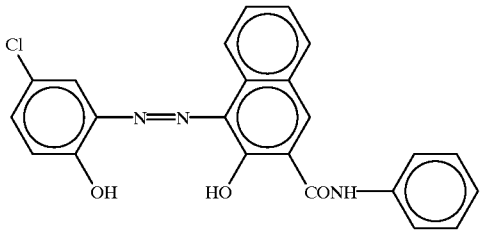

$D^{22}$

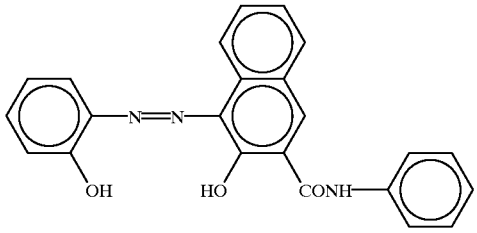

TABLE 3-continued

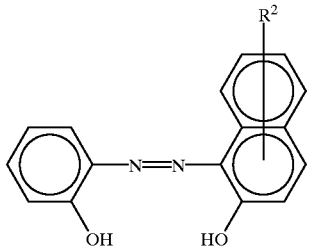

D R2

D23

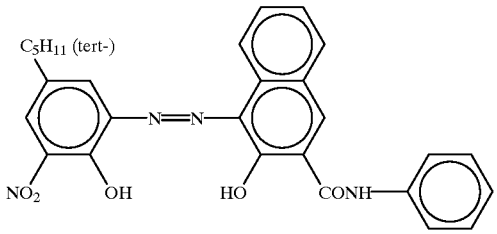

D24

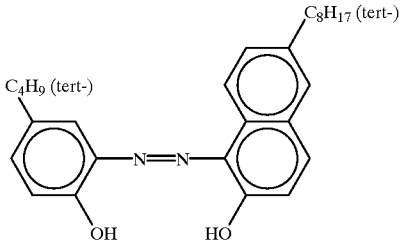

D25

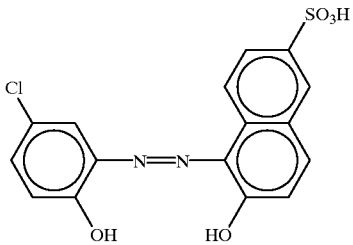

D26

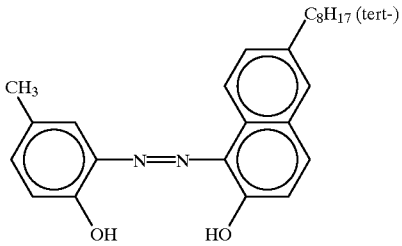

D27

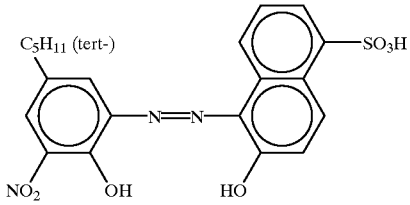

Examples of amorphous metal complex salts as charge control agents in the present invention include mixtures as described above, which comprise at least 1 kind selected from the group consisting of Example Compounds (1) through (33) below and complex salt compounds thereof.

(1): $[(D^{11})_2\cdot(Fe^{3+})_1]\ (H^+)$
(2): $[(D^{11})_2\cdot(Fe^{3+})_1]\ (NH_4^+)$
(3): $[(D^{11})_3\cdot(Fe^{3+})_2]$
(4): $[(D^5)_2\cdot(Fe^{3+})_1]\ (H^+)$
(5): $[(D^5)_2\cdot(Fe^{3+})_1]\ (K^+)$
(6): $[(D6)_2\cdot(Fe^{3+})_1]\ (H^+)$
(7): $[(D^6)_2\cdot(Fe^{3+})_1]\ (N(CH_3)_4^+)$
(8): $[(D^{23})_2\cdot(Fe^{3+})_1]\ (NH_4^+)$
(9): $[(D^7)_2\cdot(Fe^{3+})_1]\ (K^+)$
(10): $[(D^{26})_2\cdot(Fe^{3+})_1]\ (Na^+)$
(11): $[(D^{25})_2\cdot(Fe^{3+})_1]\ (H^+)$
(12): $[(D^8)_2\ (Fe^{3+})_1]\ (H^+)$
(13): $[(D^{21})_2\cdot(Fe^{3+})_1]\ (NH_4^+)$
(14): $[(D^{21})_3\cdot(Fe^{3+})_2]$
(15): $[(D^{24})_2\cdot(Fe^{3+})_1]\ (NH_4^+)$
(16): $[(D^{24})_2\cdot(Fe^{3+})_1]\ (H^+)$
(17): $[(D^2)_2\cdot(Fe^{3+})_1]\ (H^+)$
(18): $[(D^1)_3\cdot(Fe^{3+})_2]$
(19): $[(D^1)_2\cdot(Fe^{3+})_1]\ (H^+)$
(20): $[(D^1)_3\cdot(Fe^{3+})_2]$
(21): $[(D^1)_6\cdot(Fe^{3+})_4]$ (22): $[(D^1)_2\cdot(Fe^{3+})_1]$ 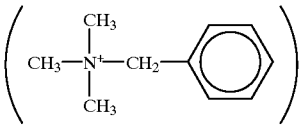

(23): $[(D^{11})_1\cdot(Fe^{2+})_1]$
(24): $[(D^{11})_2\cdot(Fe^{2+})_1]\ (H^+)_2$
(25): $[(D^{11})_3\cdot(Fe^{2+})_2]\ (H^+)_2$
(26): $[(D^{11})_6\cdot(Fe^{2+})_4]\ (H^+)_4$
(27): $[(D^{24})_2\cdot(Fe^{2+})_1]\ (H^+)_2$
(28): $[(D^{24})_2\cdot(Fe^{2+})_1]\ (NH_4^+)_2$
(29): $[(D^{24})_2\cdot(Fe^{2+})_2]\ (NH_4)_2$
(30): $[(D^{24})_3\cdot(Fe^{2+})_2]\ (H_{+)}$
(31): $[(D^{21})_3\cdot(Fe^{2+})_1]\ (NH_4)_2$
(32): $[(D^{21})_3\cdot(Fe^{2+})_2]\ (NH_4^+)_2$ (33): $[(D^1)_1\cdot(Fe^{2+})_1]$ Although the amorphous metal complex salt compounds of the monoazo series as charge control agents in the present invention are not subject to limitation as to physical and chemical characteristics, it is desirable that they be finely pulverized products having an average particle diameter of not more than 20 Am, preferably not more than 10 $\mu$m, and more preferably not more than 5 $\mu$m.

Surprisingly, the compatibility (wettability) of the amorphous metal complex salt compounds of the present invention with resins for toners is markedly higher than that of crystalline metal complex salt compounds having the same chemical structure.

Next, the toner of the present invention for developing electrostatic images comprises at least 1 kind of the above described amorphous metal complex salt compound as a charge control agent in the present invention, a resin for toners, and a coloring agent. Accordingly, the toner of the present invention may contain 1 kind of the charge control agent of the present invention, and may contain a mixture of a number of kinds of metal complex salts sharing the same ligand D and metal M, as described above.

The toner of the present invention for developing electrostatic images desirably incorporates 1 kind or a mixture of 2 or more kinds of the above described amorphous metal complex salt compound as a charge control agent in a ratio of 0.1 to 10 parts by weight per 100 parts by weight of the resin for toners. More preferably, the amount of charge control agent added is 0.5 to 5 parts by weight per 100 parts by weight of the resin for toners.

Examples of resins useful in the toner of the present invention include the following known resins for toners (binder resins or toner resins). Specifically, useful resins include thermoplastic resins such as styrene resin, styrene-acrylic resin, styrene-butadiene resin, styrene-maleic acid resin, styrene-vinyl methyl ether resin, styrene-methacrylic acid ester copolymer, polyester resin and polypropylene resin. These resins may be used singly or in blends.

Also, the charge control agent of the present invention can be used to control or enhance the charge of a resin powder by being contained in an electrostatic powder paint (powder coating for electrostatic painting), which may contain a coloring agent. Useful resins for paints (powder coating) for this purpose include thermoplastic resins of the acryl-series, polyolefin series, polyester-series or polyamide-series; and thermosetting resins of the phenol-series, epoxy-series, polyester-series or other series; these resins may be used singly or in blends.

In the toner of the present invention for developing electrostatic images, a large number of known dyes and pigments can be used singly or in blend as coloring agents. Examples of useful coloring agents include organic pigments such as Quinophthalone Yellow, Isoindolinone Yellow, Perynone Orange, Perynone Red, Perylene Maroon, Rhodamine 6G Lake, Quinacridone Red, Anthanthrone Red, Rose Bengale, Copper Phthalocyanine Blue, Copper Phthalocyanine Green and diketopyrrolo pyrrole pigments; inorganic pigments such as carbon black, Titanium White, Titanium Yellow, Ultramarine, Cobalt Blue, red oxide, aluminum powder and bronze; and metal powders.

The toner of the present invention for developing electrostatic images is, for example, produced as described below.

A toner having an average particle diameter of 5 to 20 $\mu$m can be obtained by thoroughly mixing a resin for toners as described above, a coloring agent (preferably carbon black), the charge control agent of the present invention, and, if necessary, a magnetic material (e.g., ferromagnetic metal fine powder such as of iron or cobalt, ferrite), a fluidizing (flow improving) agent (e.g., silica, aluminum oxide, titanium oxide), an anti-offset agent (e.g., wax, low molecular olefin wax) and other additives, using a ball mill or another mechanical mixer, subsequently kneading the mixture in a molten state using a hot kneader such as a heat roll, kneader or extruder, cooling and solidifying the mixture, then pulverizing the solid mixture and classifying the resulting particles by size.

Other usable methods include the method in which the starting materials are dispersed in a binder resin solution and subsequently spray dried, and the polymerizing toner production method in which a given set of starting materials are mixed in a monomer to constitute a binder resin to yield an emulsified suspension, which is then polymerized to yield the desired toner.

When the toner of the present invention is used as a two-component developer, development can be achieved by the magnetic brush developing process or the like using the toner in admixture with carrier powder.

Any known carrier can be used. Examples of the carrier include iron powder, nickel powder, ferrite powder and glass beads about 50 to 200 $\mu$m in particle diameter, and such materials as coated with acrylic acid ester copolymer, styrene-acrylic acid ester copolymer, styrene-methacrylic acid ester copolymer, silicone resin, polyamide resin, ethylene fluoride resin or the like.

When the toner of the present invention is used as a one-component developer, an appropriate amount of fine powder of a ferromagnetic material such as iron powder, nickel powder or ferrite powder may be added and dispersed in preparing the toner as described above. Examples of developing processes which can be used in this case include impression development and jumping development.

EXAMPLES

The present invention is hereinafter described in more detail by means of the following examples, which are not to be construed as limitative but only as illustrative. In the description below, part(s) by weight" is referred to as "part(s)" for short.

Example 1

18.9 g (0.05 mol) of monoazo compound ($D^{11}$) synthesized by an ordinary diazotization coupling reaction using 4-tert-amyl-6-nitro-2-aminophenol and P-naphthol was added to 500 ml of N,N-dimethylformamide (DMF), followed by stirring.

To this liquid, 3.2 g (0.03 mol) of sodium carbonate was added, followed by heating to 70° C., after which 8.3 g (0.03 mol) of ferrous sulfate heptahydrate was added, followed by a reaction for 5 hours.

This reaction mixture was dispersed in water; the precipitate obtained was collected by filtration, washed with water, and dried, to yield 19.6 g (yield 96.8%) of an amorphous iron complex salt.

An X-ray diffraction spectrum of this product is shown in FIG. 1.

Example 2

Wet cake (0.05 mol, based on solid content) of monoazo compound ($D^{21}$) synthesized by an ordinary diazotization coupling reaction using 4-chloro-2-aminophenol and naphthol AS was dispersed in 500 ml of ethylene glycol.

To this dispersion, 4.0 g (0.1 mol) of sodium hydroxide was added, then 4.9 g (0.03 mol) of ferric chloride was added, followed by a reaction at 110 to 120° C. for 5 hours, to achieve metallization.

After this reaction mixture was allowed to cool to room temperature, the precipitated product was collected by filtration, washed with water, and dried, to yield 18.5 g (yield 93.2%) of a crystalline iron complex salt.

Figure 2:
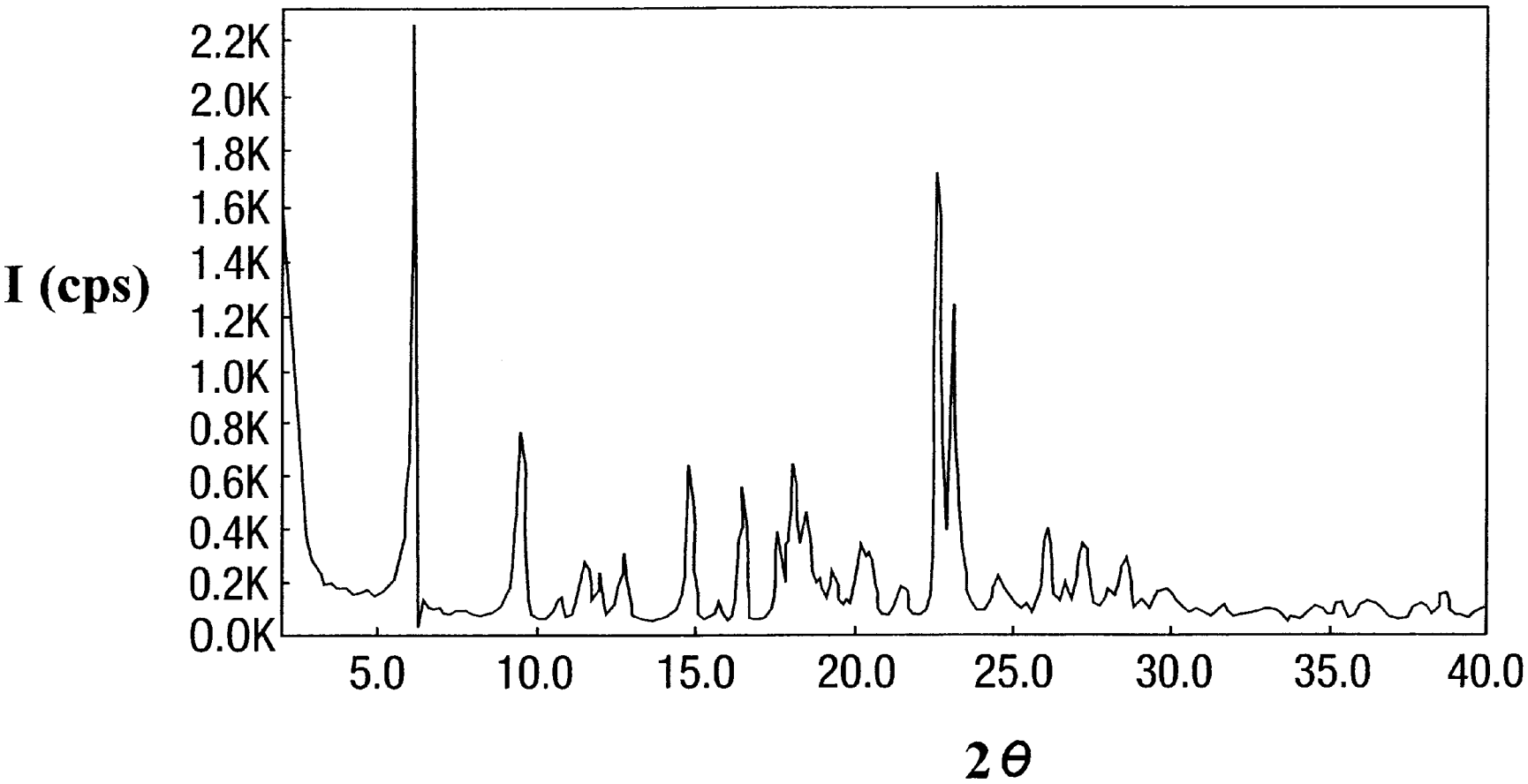
FIG. 2 is an X-ray diffraction spectrum of the crystalline iron complex salt obtained in Example 2.
Figure 3:
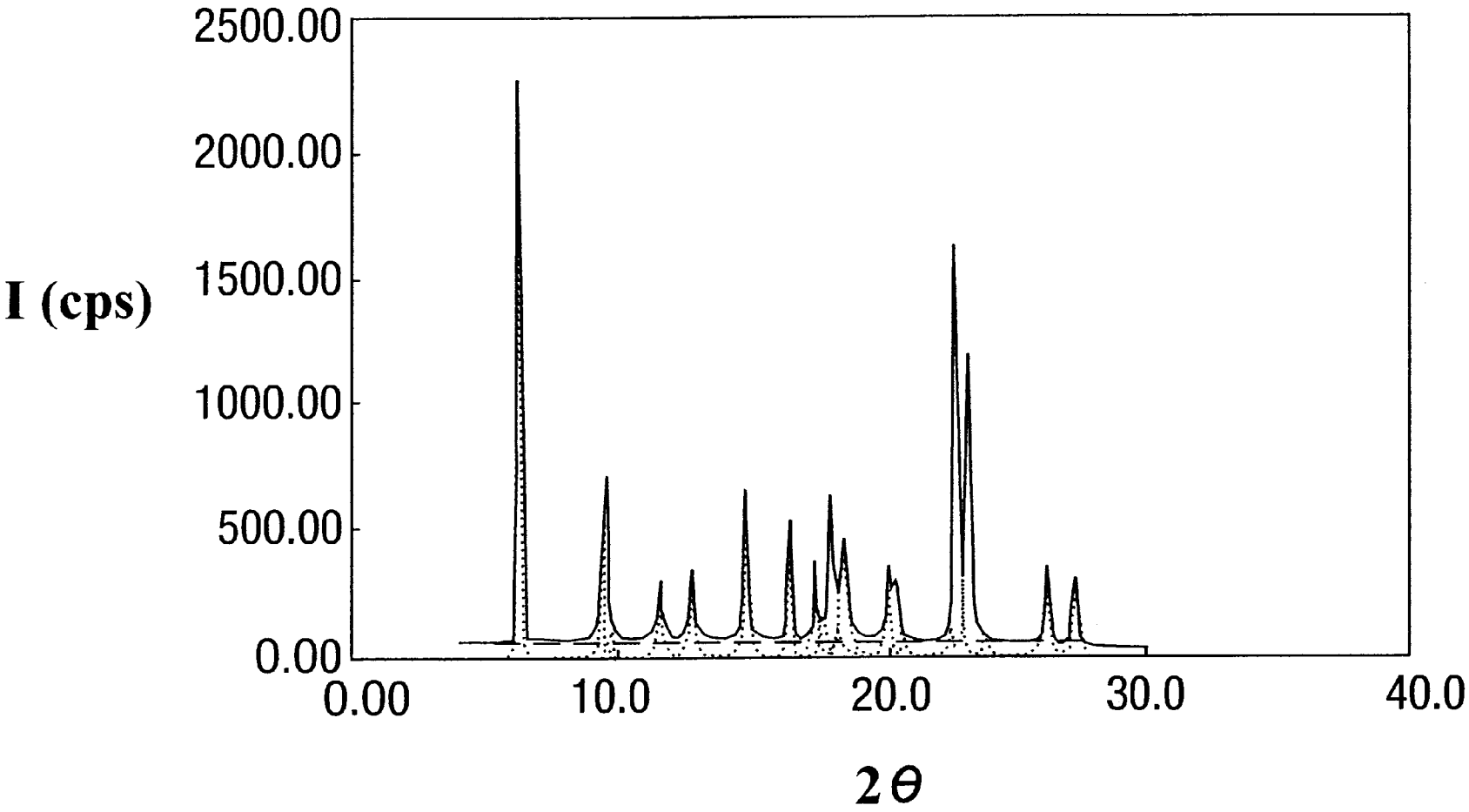
FIG. 3 is a chart obtained by smoothening the X-ray diffraction spectrum of the crystalline iron complex salt obtained in Example 2 and dividing the smoothened spectrum into 2 portions (spectra of the entire and crystalline portions).

An X-ray diffraction spectrum of this product is shown in FIG. 2. A chart obtained by smoothening the X-ray diffraction spectrum of this product over the 2θ range from 50 to 300 (wherein 0 indicates the Bragg angle) and dividing the smoothened spectrum into 2 portions (spectra for the entire and crystalline portions) using the X-ray diffraction apparatus $MXP^3$ system produced by Mac Science, is shown in FIG. 3. With respect to the spectra shown in FIG. 3, the sum of strength of the entire portion, as determined by the crystallinity determination method, over the 2θ range from 50 to 300 (wherein e indicates the Bragg angle), was 3569.3, the sum of strength of the crystalline portion was 2208.0, and the degree of crystallinity [(sum of strength of the crystalline portion/sum of strength of the entire portion)× 100] was 61.9%.

Five grams of this crystalline iron complex salt, 300 ml of glass beads of 2 mm particle diameter, and 150 ml of isopropanol, were sealed in a 500 ml wide-mouthed glass bottle and shaken using a paint shaker for 10 hours (wet milling). After the glass beads were removed from the contents of the wide-mouthed glass bottle using a wire-mesh net, the dispersion obtained was evaporated to dryness to yield an amorphous iron complex salt.

Figure 4:
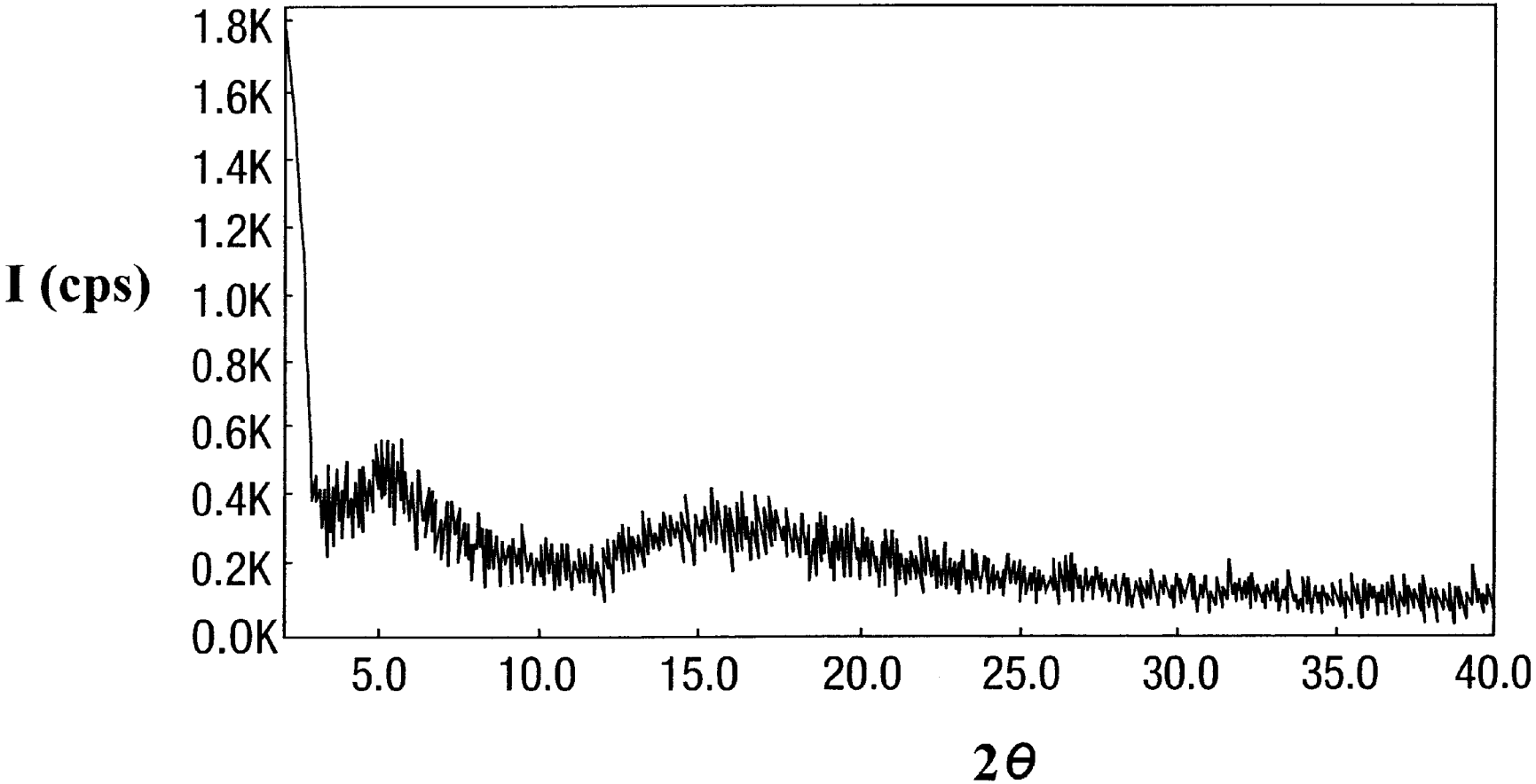
FIG. 4 is an X-ray diffraction spectrum of the amorphous iron complex salt obtained in Example 2.

An X-ray diffraction spectrum of the product obtained is shown in FIG. 4.

Example 3

Ten grams of the crystalline iron complex salt obtained in Example 2 were added to 100 ml of DMF, followed by heating at 70° C. until it dissolved, after which the solution was dispersed in 500 ml of water. To this mixture, 5 g of sodium chloride (NaCl) were added during stirring; after heating to 50° C., this mixture was filtered; the product collected by filtration was washed with water and dried to yield 9.7 g of an amorphous iron complex salt.

Figure 5:
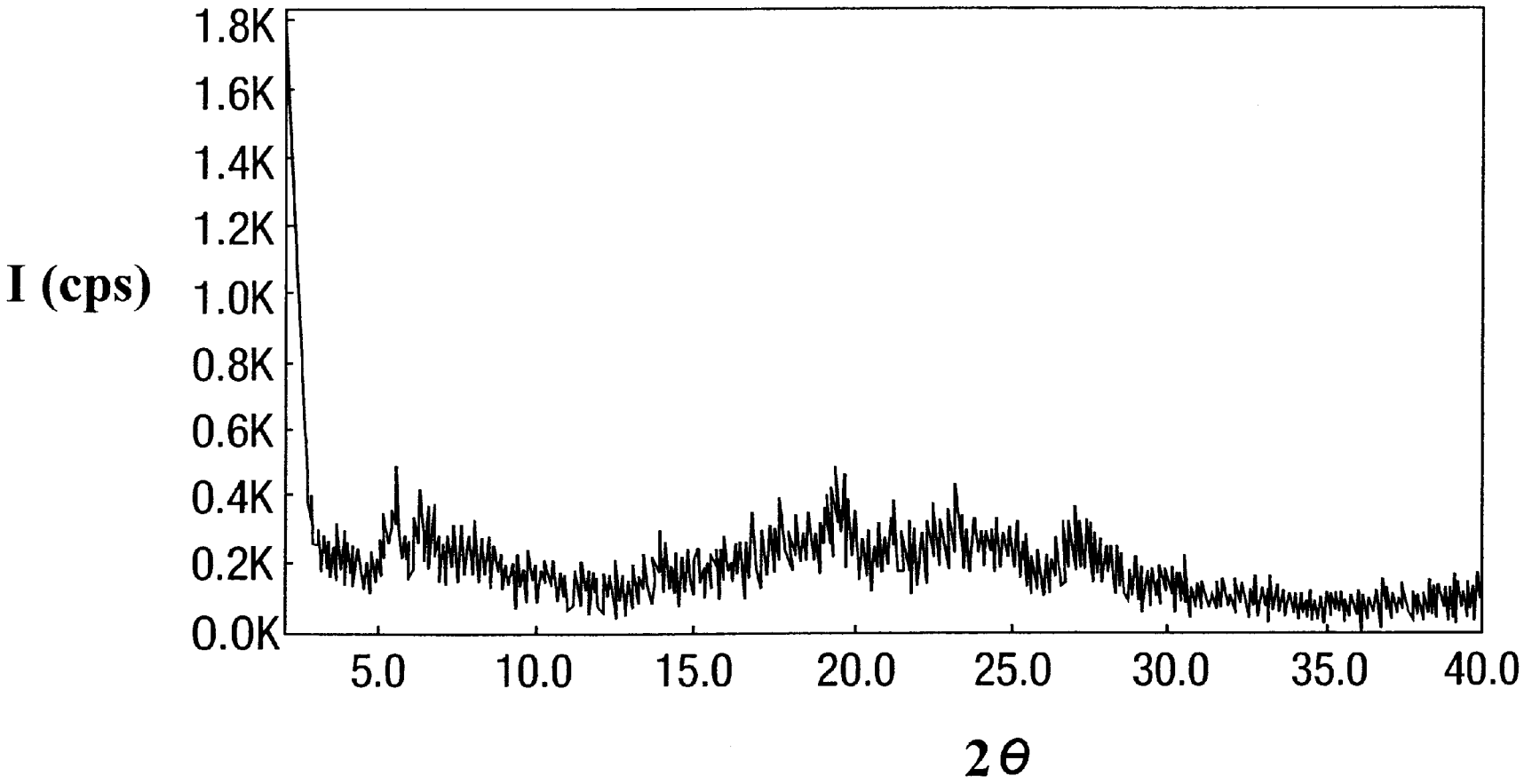
FIG. 5 is an X-ray diffraction spectrum of the amorphous iron complex salt obtained in Example 3.

An X-ray diffraction spectrum of this product is shown in FIG. 5.

Figure 6:
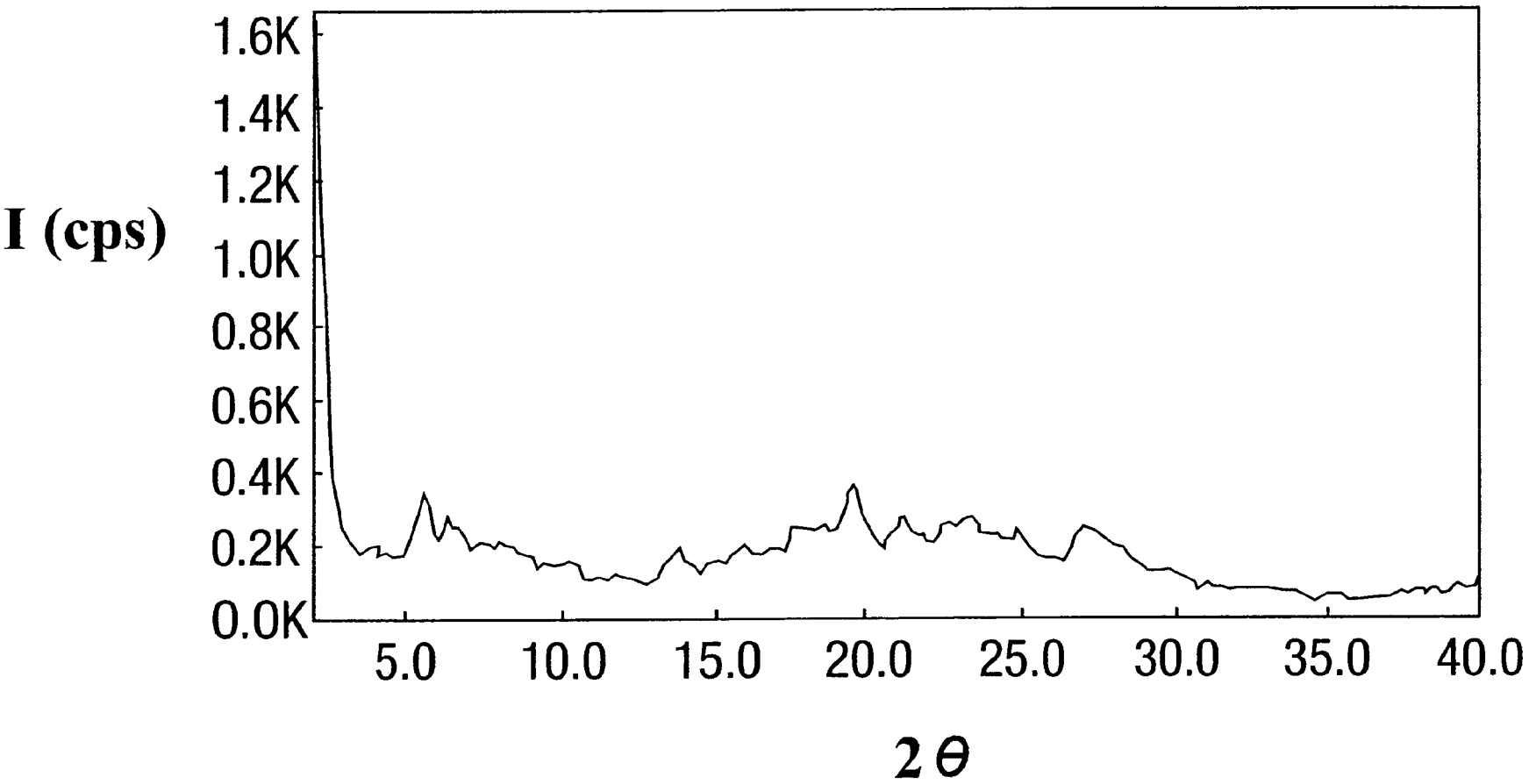
FIG. 6 is a spectrum resulting from a smoothening treatment of the X-ray diffraction spectrum of the amorphous iron complex salt obtained in Example 3.
Figure 7:
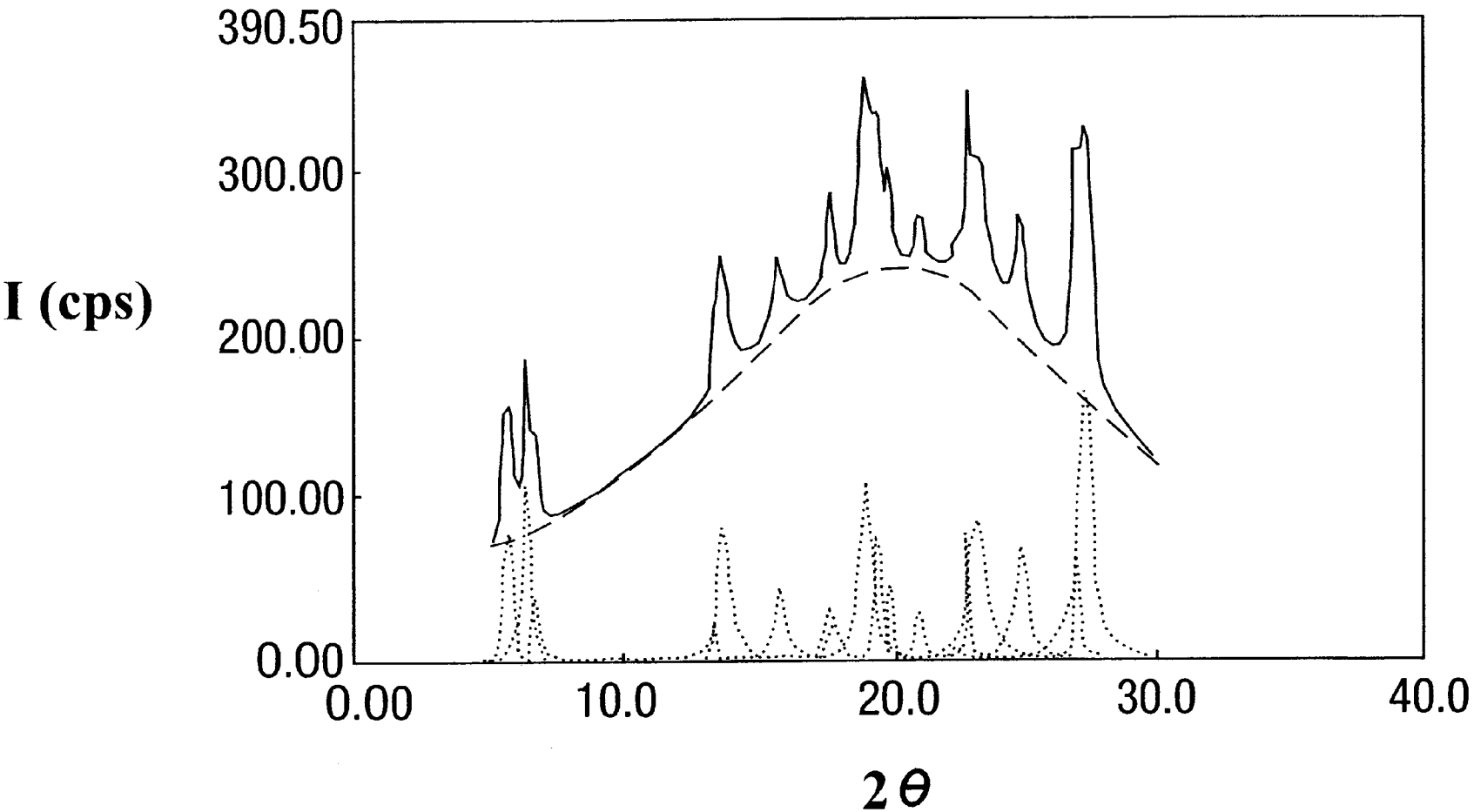
FIG. 7 is a chart obtained by dividing the spectrum of FIG. 6 into 2 portions (spectra of the entire and crystalline portions).

An X-ray diffraction spectrum of this product after a smoothening treatment over the 2θ range from 5° to 30° (wherein 0 indicates the Bragg angle) using the X-ray diffraction apparatus $MXP^3$ system produced by Mac Science, is shown in FIG. 6; and a chart obtained by dividing the X-ray diffraction spectrum into 2 portions (spectra of the entire and crystalline portions) is shown in FIG. 7.

With respect to the spectra shown in FIG. 7, the sum of strength of the entire portion, as determined by the crystallinity determination method, over the 2θ range from 5° to 30° (wherein θ indicates the Bragg angle), was 4889.0, the sum of strength of the crystalline portion was 682.6, and the degree of crystallinity [(sum of strength of the crystalline portion/sum of strength of the entire portion)×100] was 14.0%.

The toner of the present invention for developing electrostatic images is hereinafter described with reference to Examples I through VI.

Example I 100 parts—styrene-acrylic copolymer resin [HIMER SMB600 (trade name), produced by Sanyo Kasei Co., Ltd.].

3 parts—low polymer polypropylene [Biscal 550P (trade name), produced by Sanyo Kasei Co., Ltd.].

7 parts—carbon black [MA-100 (trade name), produced by Mitsubishi Chemical Industries, Ltd.].

2 parts—charge control agent (amorphous iron complex salt obtained in Example 1).

The above ingredients were uniformly pre-mixed using a high-speed mill to yield a premix, which was then kneaded in a molten state using a heat roll, cooled and thereafter roughly milled using an ultracentrifugal mill. The rough milling product obtained was finely pulverized using an air jet mill equipped with a classifier to yield a black toner 5 to 15 μm in particle diameter.

Five parts of this toner were admixed with 95 parts of iron powder carrier [trade name: TEFV 200/300, produced by Powdertech Co., Ltd.) to yield a developer.

After the developer obtained was vigorously stirred, the amount of charges was determined by the blowoff method (blowoff charge analyzer produced by Toshiba Chemical Corporation [trade name: TB-200] used).

The amount of blowoff charges of this developer was −21.0 μC/g.

The amount of blowoff charges of this developer was stable even under low-temperature low-humidity conditions and high-temperature high-humidity conditions; storage stability was also good. When this developer was used for repeated cycles of actual imaging using a commercial copying machine, high-quality images free of density reduction and fogging were obtained, with good charge stability and sustainability and no offset phenomenon.

Figure 8:
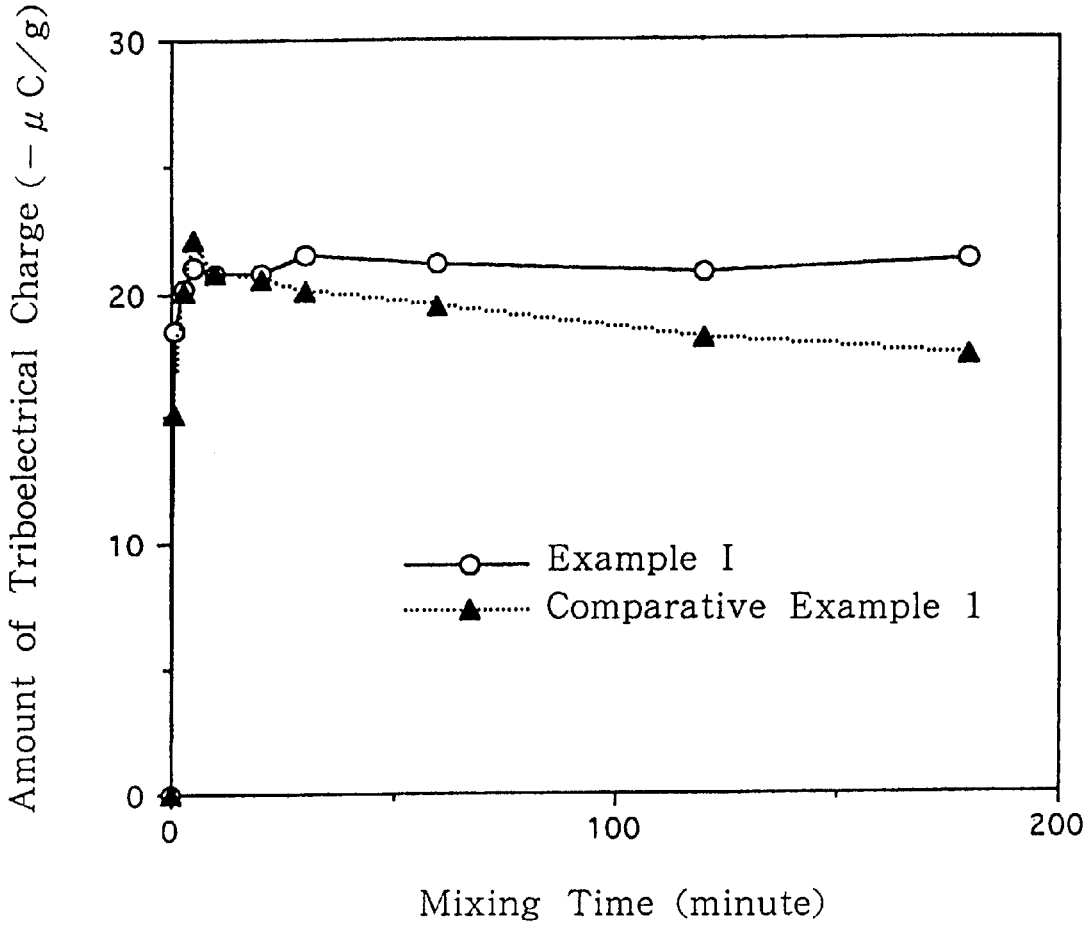
FIG. 8 shows the charge characteristics of the developer using the toner of Example 1 and the developer using the toner of Comparative Example 1.
Figure 9:
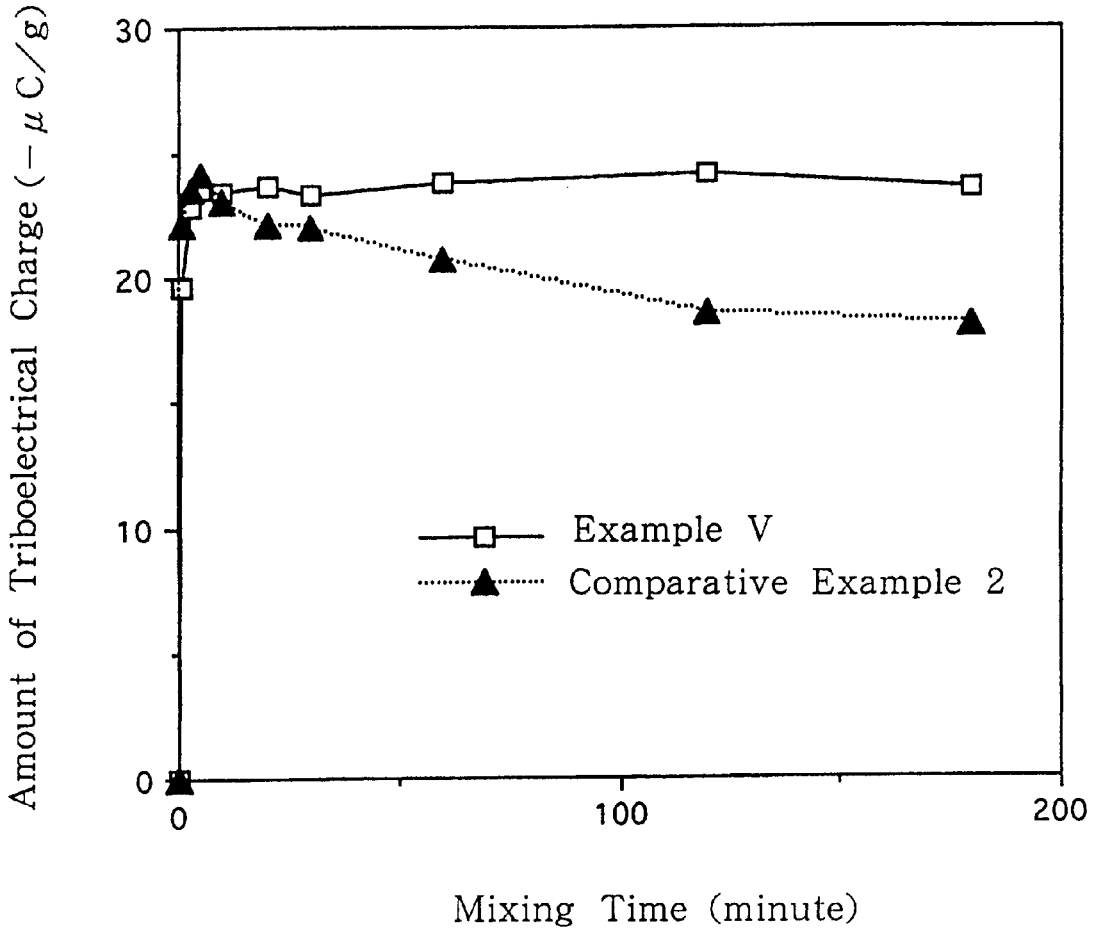
FIG. 9 shows the charge characteristics of the developer using the toner of Example V and the developer using the toner of Comparative Example 2.
Figure 10:
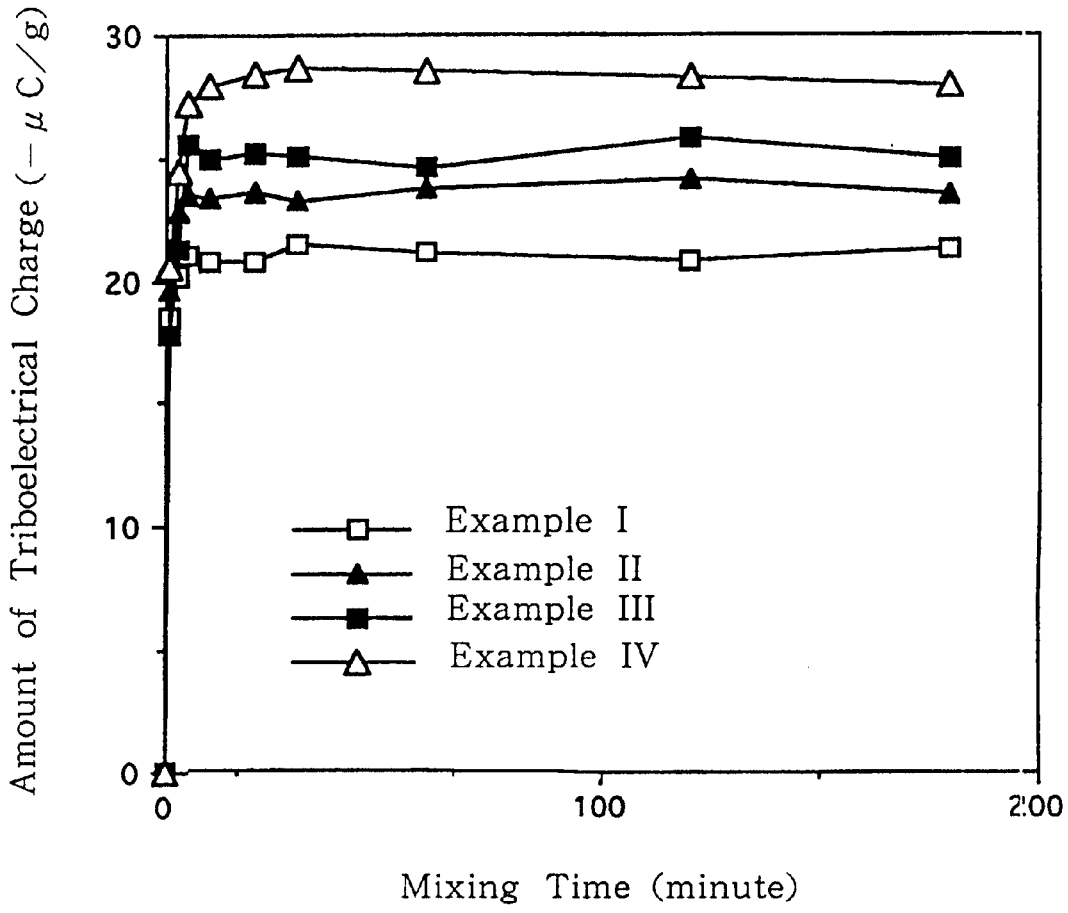
FIG. 10 shows the charge characteristics of developers using the toners of Examples I, II, III and IV, respectively.

The charge characteristics of this developer are shown in FIGS. 8 and 10. In FIGS. 8 through 10, the abscissa indicates developer mixing time (min), and the ordinate the amount of triboelectrical charges (−μC/g).

Example II

A toner and developer were prepared and evaluated in the same manner as in Example I, except that the charge control agent used in Example I was replaced by an amorphous iron complex salt having a monoazo compound ($D^1$) as a ligand.

The amount of blowoff charges of this developer was −23.3 μC/g.

The amount of blowoff charges of this developer was stable even under low-temperature low-humidity conditions and high-temperature high-humidity conditions; storage stability was also good. When this developer was used for repeated cycles of actual imaging, high-quality images free of density reduction and fogging were obtained, with good charge stability and sustainability and no offset phenomenon, as in Example I.

The charge characteristics of this developer are shown in FIG. 10.

Example III

A toner and developer were prepared and evaluated in the same manner as in Example I, except that the charge control agent used in Example I was replaced by an amorphous iron complex salt having a monoazo compound ($D^2$) as a ligand, and that the resin was replaced by a styrene-n-butyl methacrylate copolymer.

The amount of blowoff charges of this developer was −20.9 μC/g.

The amount of blowoff charges of this developer was stable even under low-temperature low-humidity conditions and high-temperature high-humidity conditions; storage stability was also good. When this developer was used for repeated cycles of actual imaging, high-quality images free of density reduction and fogging were obtained, with good charge stability and sustainability and no offset phenomenon, as in Example I.

The charge characteristics of this developer are shown in FIG. 10.

Example IV

A toner and developer were prepared and evaluated in the same manner as in Example I, except that the charge control agent used in Example I was replaced by the amorphous iron complex salt obtained in Example 2.

The amount of blowoff charges of this developer was −28.3 μC/g.

The amount of blowoff charges of this developer was stable even under low-temperature low-humidity conditions and high-temperature high-humidity conditions; storage stability was also good. When this developer was used for repeated cycles of actual imaging, high-quality images free of density reduction and fogging were obtained, with good charge stability and sustainability and no offset phenomenon, as in Example I.

The charge characteristics of this developer are shown in FIG. 10.

Example V 100 parts—polyester resin [HP-301 (trade name), produced by The Nippon Synthetic Chemical Industry, Co., Ltd.].

3 parts—low polymer polypropylene [Biscal 550P (trade name), produced by Sanyo Kasei Co., Ltd.].

7 parts—carbon black [MA-100 (trade name), produced by Mitsubishi Chemical Industries, Ltd.].

2 parts—charge control agent (amorphous iron complex salt obtained in Example 3).

A black toner and developer were prepared and evaluated by treating the above ingredients in the same manner as in Example I.

The amount of blowoff charges of this developer was −24.5 $\mu$C/g.

The amount of blowoff charges of this developer was stable even under low-temperature low-humidity conditions and high-temperature high-humidity conditions; storage stability was also good. When this developer was used for repeated cycles of actual imaging, high-quality images free of density reduction and fogging were obtained, with good charge stability and sustainability and no offset phenomenon, as in Example I.

The charge characteristics of this developer are shown in FIG. 9.

Example VI 100 parts—styrene-2-ethylhexyl methacrylate copolymer resin.

40 parts—triiron tetroxide (EPT-500 (trade name), produced by Toda Kogyo Corporation].

3 parts—low polymer polypropylene (Biscal 55OP (trade name), produced by Sanyo Kasei Co., Ltd.].

7 parts—carbon black [MA-100 (trade name), produced by Mitsubishi Chemical Industries, Ltd.].

Charge control agents:

1.5 parts—Example Compound (1).

0.2 part—Example Compound (3).

The above ingredients were uniformly pre-mixed using a ball mill to yield a premix, which was then kneaded in a molten state using a heat roll, cooled and thereafter roughly milled, finely pulverized and classified by size to yield a one-component toner 5 to 15 $\mu$m in particle diameter.

When this toner was used for a commercial copying machine to form toner images, images with good thin-line reproducibility were obtained. Also, even in continuous copying, the image density was stable, with no staining due to toner splashing.

Comparative Example 1

A toner and developer were prepared in the same manner as in Example I, except that the charge control agent of the present invention used in Example I (amorphous iron complex salt obtained in Example 1) was replaced by the crystalline iron complex salt described in Example 2, and their charge characteristics were compared. The results are shown in FIG. 8.

Actual imaging characteristics: When about 50,000 copies had been made, fogging occurred, with image quality reduction. Flaws were noted on the organic photoreceptor.

Comparative Example 2

A toner and developer were prepared in the same manner as in Example V, except that the charge control agent of the present invention used in Example V (amorphous iron complex salt obtained in Example 3) was replaced by the crystalline iron complex salt described in Example 2, and their charge characteristics were compared. The results are shown in FIG. 9.

Actual imaging characteristics: When about 50,000 copies had been made, fogging occurred, with image quality reduction. Flaws were noted on the organic photoreceptor.

With regard to the above, the produced iron complex salt compound in Example 1 is a mixture mainly containing a 2:3 type compound $[(D^{11})_3\cdot(Fe^{2+})_2]\,(H^+)_2$ having $D^{11}$ as ligands and a 1:2 type compound $[(D^{11})_2\cdot(Fe^{2+})_1]$ (H+) having $D^{11}$ as ligands, that in Example 2 is a mixture mainly containing a 2:3 type compound $[(D^{21})_3\cdot(Fe^{3+})_2]$ having $D^{21}$ as ligands and a 1:2 type compound $[(D^{21})_2\cdot(Fe^{3+})_1]\,(H^+)$ having $D^{21}$ as ligands, and that in Example 3 is a mixture mainly containing a 2:3 type compound $[(D^{21})_3\cdot(Fe^{3+})_2]$ having $D^{21}$ as ligands and a 1:2 type compound $[(D^{21})_2\cdot(Fe^{3+})_1]\,(H^+)$ having $D^{21}$ as ligands.

In many cases, when the metallizing reaction is conducted in a nonpolar aprotic solvent such as DMF or a water system, an amorphous (degree of crystallinity lower than 50%) product is directly formed, whereas when it is conducted in a polyalcohol such as ethylene glycol or glycol monoether such as ethylene glycol monoalkly ether, the product is formed as a crystalline product.

The contemplated naphthol AS compounds include those based on 3-hydroxy-2-naphthoic acid anilides.

It is clear from the foregoing that the present invention concerns a charge control agent comprising an amorphous metal complex salt compound having a monoazo compound as a ligand, e.g. a dye D, such as with the central atom of metal M being Fe, Co, Zn, Cu, Ni, Cr, Al, Ti or Si, preferably Fe, the degree of crystallinity of said amorphous compound being not higher than 50% as stated, and preferably lower than 50%, such that the amorphous content thereof is predominant, i.e. not lower than 50%, and preferably higher than 50%, especially higher than 70%, e.g. higher than 85%, as stated.

Preferably, the amorphous metal complex salt compound of the present invention is of General Formula (I), and especially contemplates the corresponding amorphous metal complex salt compounds of Formula 1, Formula 2, Formula 3 and Formula 4.

Moreover, the present invention concerns manufacturing processes for obtaining the desired amorphous metal complex salt compound by converting the corresponding crystalline compound thereto (1) by wet milling in an organic solvent or (2) by redispersing into water such crystalline compound from a solution thereof in an organic solvent.

Also, the present invention concerns a toner for developing electrostatic images comprising the desired amorphous metal complex salt compound together with a toner resin and a coloring agent, as well as a method of using said toner for developing electrostatic images in view of the enhancing qualities and characteristics of said amorphous compound.

While specific embodiments of the invention have been shown and described in detail to illustrate the application of the principles of the invention, it will be understood that the invention may be embodied otherwise without departing from such principles.

What is claimed is:

1. Charge control agent comprising an amorphous metal complex salt compound which exhibits an X-ray diffraction spectrum indicating that the degree of crystallinity thereof, as determined by the multiple peak separation method, is not higher than 30% over the 2θ range from 5° to 30°, wherein θ is the Bragg angle, the amorphous metal complex salt compound having the formula (1):

(I)

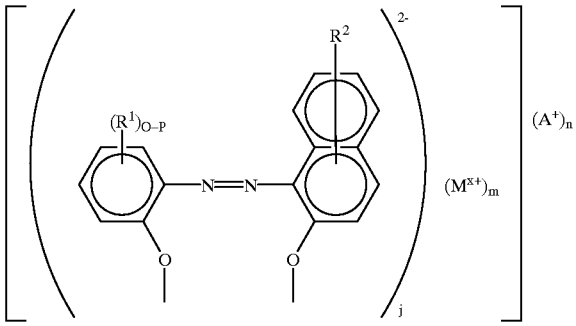

wherein $(R^1)_{0-p}$ means the presence of 0 to p units of the substituent $R^1$;

$R^1$ is an alkyl group that is substituted or unsubstituted; a cycloalkyl group; a halogen; a nitro group; an alkenyl group; an aryl group that is ring substituted or unsubstituted; an aralkyl group that is ring substituted or unsubstituted; or an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted;

p is an integer from 1 to 4;

$R^2$ is H; an alkyl group that is branched or unbranched; a halogen; a nitro group; an alkenyl group; an aryl group that is ring substituted or unsubstituted; an aralkyl group that is ring substituted or unsubstituted; $—SO_3L$ in which L is H, Na, K, $NH_4^+$ or organic ammonium; an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted, or a $—CON(R^{12})_2$ group in which the 2 units of $R^{12}$, which may be the same or different, are each H, a lower alkyl group, an aryl group that is ring substituted or unsubstituted, or an aralkyl group that is ring substituted or unsubstituted;

j is 1, 2, 3 or 6, representing the number of monoazo compound molecules coordinated to the metal M;

$(M^{x+})_m$ represents m units of a metal M having an atomic valency of x, $M^{x+}$ is $Fe^{2+}$ or $Fe^{3+}$, m being an integer of 1, 2 or 4; and $(A^+)_n$ represents n units of a counter-ion $A^+$ selected from the group consisting of $H^+$, $NH_4^+$, $Na^+$, $K^+$ and organic ammonium, in which $n=2j-mx$, $2j \geqq mx$, provided that when j=1 and x is 2, n is 0.

2. Charge control agent of claim 1 wherein the amorphous metal complex salt compound has been prepared by subjecting a corresponding crystalline metal complex salt compound to wet milling in an organic solvent.

3. Charge control agent of claim 1 wherein the amorphous metal complex salt compound has been prepared by dissolving a corresponding crystalline metal complex salt compound in an organic solvent, and thereafter re-dispersing the dissolved metal complex salt compound in water.

4. Charge control agent of claim 1 wherein the amorphous metal complex salt compound is selected from the group consisting of a 1:2 metal complex salt compound of formula (I) wherein j is 2, m is 1 and n is 4-x;

a 2:3 metal complex salt compound of formula (I) wherein j is 3, m is 2 and n is 6-2x;

a 4:6 metal complex salt compound of formula (1) wherein j is 6, m is 4 and n is 12-4x;

a 1:1 metal complex salt compound of formula (I) wherein j is 1, m is 1, x is 2 and n is 0; and mixtures thereof.

5. Charge control agent comprising an amorphous metal complex salt compound which exhibits an X-ray diffraction spectrum indicating that the degree of crystallinity thereof, as determined by the multiple peak separation method, is not higher than 30% over the 2θ range from 5° to 30°, wherein θ is the Bragg angle, the amorphous metal complex salt compound having the formula (I):

(I)

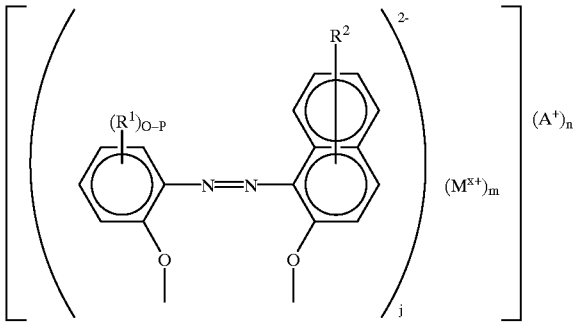

wherein (means the presence of 0 to p units of the substituent $R^1$;

$R^1$ is an alkyl group that is substituted or unsubstituted; a cycloalkyl group; a halogen; a nitro group; an alkenyl group; an aryl group that is ring substituted or unsubstituted; an aralkyl group that is ring substituted or unsubstituted; or an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted;

p is an integer from 1 to 4;

$R^2$ is H; an alkyl group that is branched or unbranched; a halogen; a nitro group; an alkenyl group; an aryl group that is ring substituted or unsubstituted; an aralkyl group that is ring substituted or unsubstituted; $—SO_3L$ in which L is H, Na, K, $NH_4^+$ or organic ammonium; an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted, or a $—CON(R^{12})_2$ group in which the 2 units of $R^{12}$, which may be the same or different, are each H, a lower alkyl group, an aryl group that is ring substituted or unsubstituted, or an aralkyl group that is ring substituted or unsubstituted;

j is 1, 2, 3 or 6, representing the number of monoazo compound molecules coordinated to the metal M;

$(M^{x+})_m$ represents m units of a metal M having an atomic valency of x, $M^{x+}$ is $Fe^{2+}$ or $Fe^{3+}$, m being an integer of 1, 2 or 4; and $(A^+)_n$ represents n units of a counter-ion $A^+$ selected from the group consisting of $H^+$, $NH_4^+$, $Na^+$, $K^+$ and organic ammonium, in which n=2j−mx, 2j≧mx, provided that when j=1 and x is 2, n is 0;

the amorphous metal complex salt compound having been prepared by subjecting a corresponding crystalline metal complex salt compound to wet milling in an organic solvent; and the amorphous metal complex salt compound being selected from the group consisting of a 1:2 metal complex salt compound of formula (I) wherein j is 2, m is 1 and n is 4-x;

a 2:3 metal complex salt compound of formula (I) wherein j is 3, m is 2 and n is 6-2x;

a 4:6 metal complex salt compound of formula (I) wherein j is 6, m is 4 and n is 12-4x;

a 1:1 metal complex salt compound of formula (I) wherein j is 1, m is 1, x is 2 and n is 0; and mixtures thereof.

6. Charge control agent comprising an amorphous metal complex salt compound which exhibits an X-ray diffraction spectrum indicating that the degree of crystallinity thereof, as determined by the multiple peak separation method, is not higher than 30% over the 2θ range from 5° to 30°, wherein θ is the Bragg angle, the amorphous metal complex salt compound having the formula (I):

(I)

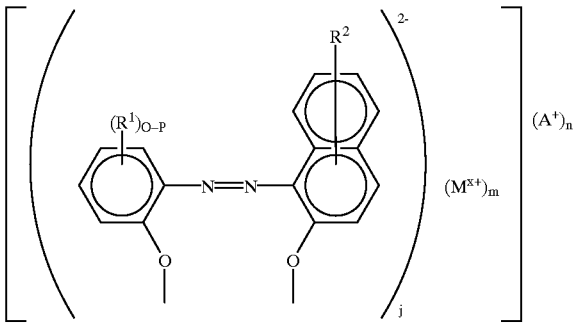

wherein $(R^1)_{0-p}$ means the presence of 0 to p units of the substituent $R^1$;

$R^1$ is an alkyl group that is substituted or unsubstituted; a cycloalkyl group; a halogen; a nitro group; an alkeny) group; an aryl group that is ring substituted or unsubstituted; an aalkyl group that is ring substituted or unsubstituted; or an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted;

p is an integer from 1 to 4;

$R^2$ is H; an alkyl group that is branched or unbranched; a halogen, a nitro group; an alkenyl group; an aryl group that is ring substituted or unsubstituted; an aralkyl group that is ring substituted or unsubstituted; $—SO_3L$ in which L is H, Na, K, $NH_4^+$ or organic ammonium; an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted, or a $—CON(R^2)_2$ group in which the 2 units of $R^{12}$, which may be the same or different, are each H, a lower alkyl group, an aryl group that is ring substituted or unsubstituted, or an aralkyl group that is ring substituted or unsubstituted;

j is 1, 2, 3 or 6, representing the number of monoazo compound molecules coordinated to the metal M;

$(M^{x+})_m$ represents m units of a metal M having an atomic valency of x, $M^{x+}$ is $Fe^{2+}$ or $Fe^{3+}$, m being an integer of 1, 2 or 4; and $(A^+)_n$ represents n units of a counter-ion $A^+$ selected from the group consisting of $H^+$, $NH_4^+$, $Na^+$, $K^+$ and organic ammonium, in which n=2j−mx, 2j≧mx, provided that when j=1 and x is 2, n is 0;

the amorphous metal complex salt compound having been prepared by dissolving a corresponding crystalline metal complex salt compound in an organic solvent, and thereafter re-dispersing the dissolved metal complex salt compound in water; and the amorphous metal complex salt compound being selected from the group consisting of a 1:2 metal complex salt compound of formula (I) wherein j is 2, m is 1 and n is 4-x;

a 2:3 metal complex salt compound of formula (I) wherein j is 3, m is 2 and n is 6-2x;

a 4:6 metal complex salt compound of formula (I) wherein j is 6, m is 4 and n is 12-4x;

a 1:1 metal complex salt compound of formula (I) wherein j is 1, m is 1, x is 2 and n is 0; and mixtures thereof.

7. Charge control agent consisting essentially of an amorphous metal complex salt compound which exhibits an X-ray diffraction spectrum indicating that the degree of crystallinity thereof, as determined by the multiple peak separation method, is not higher than 30% over the 2θ range from 5° to 30°, wherein 6 is the Bragg angle, the amorphous metal complex salt compound having the formula (I):

(I)

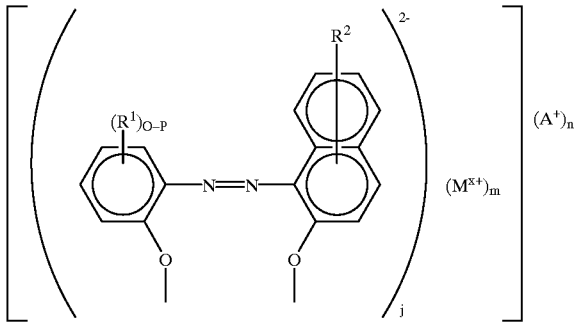

wherein $(R^1)_{0-p}$ means the presence of 0 to p units of the substituent $R^1$;

$R^1$ is an alkyl group that is substituted or unsubstituted; a cycloalkyl group; a halogen; a nitro group; an alkenyl group; an aryl group -hat is ring substituted or unsubstituted; an aralkyl group that is ring substituted or unsubstituted; or an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted;

p is an integer from 1 to 4;

$R^2$ is H; an alkyl group that is branched or unbranched; a halogen; a nitro group; an alkenyl group; an aryl group that is ring substituted or unsubstituted; an aralkyl group that is ring substituted or unsubstituted; $—SO_3L$ in which L is H, Na, K, $NH_4^+$ or organic ammonium; an $—SO_2N(R^{11})_2$ group in which the 2 units of $R^{11}$, which may he the same or different, are each H, a lower alkyl group, an aryl group that is ring substituted or unsubstituted, or an aralkyl croup that is ring substituted or unsubstituted, or a $—CON(R^{2})_2$ group in which the 2 units of $R^{12}$, which may be the same or different, are each H, a lower alkyl group, an aryl group that is ring substituted or unsubstituted, or an aralkyl group that is ring substituted or unsubstituted;

j is 1, 2, 3 or 6, representing the number of monoazo compound molecules coordinated to the metal M;

$(M^{x+})_m$ represents m units of a metal M having an atomic valency of x, $M^{x+}$ is $Fe^{2+}$ or $Fe^{3+}$, m being an integer of 1, 2 or 4; and $(A^+)_n$ represents n units of a counter-ion $A^+$ selected from the group consisting of $H^+$, $NH_4^+$, $Na^+$, $K^+$ and organic ammonium, in which $n=2j-mx$, $2j \geqq mx$, provided that when j=1 and x is 2, n is 0.

8. Charge control agent of claim 7 wherein $R^1$ is an alkyl group having 1 to 12 carbon atoms that is branched or unbranched, and $R^2$ is H.

9. Charge control agent of claim 7 wherein $R^1$ is an alkyl group having 1 to 12 carbon atoms that is branched or unbranched, and $R^2$ is an alkyl group having 1 to 12 carbon atoms that is branched or unbranched.

10. Charge control agent of claim 7 wherein the amorphous metal complex salt compound is a 1:2 metal complex salt compound of formula (I) wherein j is 2, m is 1 and n is 4-x.

11. Charge control agent of claim 7 wherein the amorphous metal complex salt compound is a 2:3 metal complex salt compound of formula (I) wherein j is 3, m is 2 and n is 6-2x.

12. Charge control agent of claim 7 wherein the amorphous metal complex salt compound is a 4:6 metal complex salt compound of formula (I) wherein j is 6, m is 4 and n is 12-4x.

13. Charge control agent of claim 7 wherein the amorphous metal complex salt compound is a 1:1 metal complex salt compound of formula (I) wherein j is 1, m is 1, x is 2 and n is 0.

14. Charge control agent of claim 7 wherein the amorphous metal complex salt compound is a mixture of a 1:2 metal complex salt compound of formula (I) wherein j is 2, m is 1 and n is 4-x; and a 2:3 metal complex salt compound of formula (I) wherein j is 3, m is 2 and n is 62x.

15. Charge control agent of claim 7 wherein the amorphous metal complex salt compound is a mixture of a 2:3 metal complex salt compound of formula (I) wherein j is 3, m is 2 and n is 6-2x; and a 4:6 metal complex salt compound of formula (1) wherein j is 6, m is 4 and n is 12-4x.

16. Charge control agent of claim 7 wherein the amorphous metal complex salt compound is a mixture of a 1:2 metal complex salt compound of formula (I) wherein j is 2, m is 1 and n is 4-x; a 2:3 metal complex salt compound of formula (1) wherein j is 3, m is 2 and n is 6-2x; a 4:6 metal complex salt compound of formula (1) wherein j is 6, m is 4 and n is 12-4x; and a 1:1 metal complex salt compound of formula (I) wherein j is 6, m is 1, x is 2 and n is 0.

17. Toner for developing electrostatic images comprising a charge control agent, a toner resin, and a coloring agent, wherein the charge control agent comprises an amorphous metal complex salt compound which exhibits an X-ray diffraction spectrum indicating that the degree of crystallinity thereof, as determined by the multiple peak separation method, is not higher than 30% over the 2θ range from 5° to 30°, wherein θ is the Bragg angle, the amorphous metal complex salt compound having the formula (I):

(I)

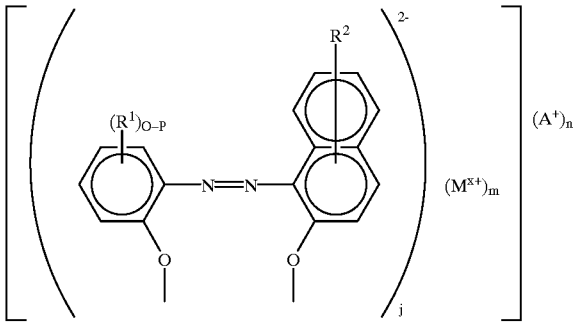

wherein $(R^1)_{0-p}$ means the presence of 0 to p units of the substituent $R^1$;

$R^1$ is an alkyl group that is substituted or unsubstituted; a cycloalkyl group; a halogen;

a nitro group; an alkenyl group; an aryl group that is ring substituted or unsubstituted; an aralkyl group that is ring substituted or unsubstituted; or an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted;

p is an integer from 1 to 4;

$R^2$ is H; an alkyl group that is branched or unbranched; a halogen; a nitro group; an alkenyl group; an aryl group that is ring substituted or unsubstituted; an aralkyl group that is ring substituted or unsubstituted; $—SO_3L$ in which L is H, Na, K, $NH_4^+$ or organic ammonium; an $—SO_2N(R^{11})_2$ group in which the 2 units of $R^{11}$, which may be the same or different, are each H, a lower alkyl group, an aryl group that is ring substituted or unsubstituted, or an aralkyl group that is ring substituted or unsubstituted, or a $—CON(R^{12})_2$ group in which the 2 units of $R^{12}$, which may be the same or different, are each H, a lower alkyl group, an aryl group that is ring substituted or unsubstituted, or an aralkyl group that is ring substituted or unsubstituted;

j is 1, 2, 3 or 6, representing the number ofmonoazo compound molecules coordinated to the metal M;

$(M^{x+})_m$ represents m units of a metal M having an atomic valency of x, $M^{x+}$ is $Fe^{2+}$ or $Fe^{3+}$, m being an integer of 1, 2 or 4; and $(A^+)_n$ represents n units of a counter-ion $A^+$ selected from the group consisting of $H^+$, $NH_4^+$, $Na^+$, $K^+$ and organic ammonium, in which $n=2j-mx$, $2j \geqq mx$, provided that when j=1 and x is 2, n is 0.

18. Method of using a toner for developing electrostatic images with enhanced control and stabilization of the amount of triboelectrical charges, which comprises effecting the developing of the electrostatic images using the toner of claim 17.

19. Toner of claim 17 wherein the amorphous metal complex salt compound has been prepared by subjecting a corresponding crystalline metal complex salt compound to wet milling in an organic solvent.

20. Method of using a toner for developing electrostatic images with enhanced control and stabilization of the amount of triboelectrical charges, which comprises effecting the developing of the electrostatic images using the toner of claim 19.

21. Toner of claim 17 wherein the amorphous metal complex salt compound has been prepared by dissolving a corresponding crystalline metal complex salt compound in an organic solvent, and thereafter re-dispersing the dissolved metal complex salt compound in water.

22. Method of using a toner for developing electrostatic images with enhanced control and stabilization of the amount of triboelectrical charges, which comprises effecting the developing of the electrostatic images using the toner of claim 21.

23. Toner of claim 17 wherein the amorphous metal complex salt compound is selected from the group consisting of a 1:2 metal complex salt compound of formula (I) wherein j is 2, m is 1 and n is 4-x, a 2:3 metal complex salt compound of formula (I) wherein j is 3, m is 2 and n is 6-2x;

a 4:6 metal complex salt compound of formula (I) wherein j is 6, m is 4 and n is 12-4x;

a 1:1 metal complex salt compound of formula (I) wherein j is 1, m is 1, x is 2 and n is 0, and mixtures thereof.

24. Method of using a toner for developing electrostatic images with enhanced control and stabilization of the amount of triboelectrical charges, which comprises effecting the developing of the electrostatic images using the toner of claim 23.

25. Toner of claim 17 wherein $R^1$ is an alkyl group having 1 to 12 carbon atoms that is branched or unbranched, and $R^2$ is H.

26. Method of using a toner for developing electrostatic images with enhanced control and stabilization of the amount of triboelectrical charges, which comprises effecting the developing of the electrostatic images using the toner of claim 25.

27. Toner of claim 17 wherein $R^1$ is an alkyl group having 1 to 12 carbon atoms that is branched or unbranched, and $R^2$ is an alkyl group having 1 to 12 carbon atoms that is branched or unbranched.

28. Method of using a toner for developing electrostatic images with enhanced control and stabilization of the amount of triboelectrical charges, which comprises effecting the developing of the electrostatic images using the toner of claim 27.

29. Toner of claim 17 wherein the amorphous metal complex salt compound is a 1:2 metal complex salt compound of formula (I) wherein j is 2, m is 1 and n is 4-x.

30. Method of using a toner for developing electrostatic images with enhanced control and stabilization of the amount of triboelectrical charges, which comprises effecting the developing of the electrostatic images using the toner of claim 29.

31. Toner of claim 17 wherein the amorphous metal complex salt compound is a 2:3 metal complex salt compound of formula (I) wherein j is 3, m is 2 and n is 6-2x.

32. Method of using a toner for developing electrostatic images with enhanced control and stabilization of the amount of triboelectrical charges, which comprises effecting the developing of the electrostatic images using the toner of claim 31.

33. Toner of claim 17 wherein the amorphous metal complex salt compound is a 4:6 metal complex salt compound of formula (I) wherein j is 6, m is 4 and n is 12-4x.

34. Method of using a toner for developing electrostatic images with enhanced control and stabilization of the amount of triboelectrical charges, which comprises effecting the developing of the electrostatic images using the toner of claim 33.

35. Toner of claim 17 wherein the amorphous metal complex salt compound is a 1:1 metal complex salt compound of formula (1) wherein j is 1, m is 1, x is 2 and n is 0.

36. Method of using a toner for developing electrostatic images with enhanced control and stabilization of the amount of triboelectrical charges, which comprises effecting the developing of the electrostatic images using the toner of claim 35.

* * * * *